US007722456B2

(12) United States Patent
Walker et al.

(10) Patent No.: US 7,722,456 B2
(45) Date of Patent: May 25, 2010

(54) METHOD AND APPARATUS FOR ASSOCIATING SYMBOLS WITH A STATE OF A GAMING DEVICE

(75) Inventors: Jay S. Walker, Ridgefield, CT (US); James A. Jorasch, Stamford, CT (US); Geoffrey M. Gelman, Stamford, CT (US); Daniel E. Tedesco, Huntington, CT (US); Michael D. Downs, Stamford, CT (US)

(73) Assignee: IGT, Reno, NV (US)

( * ) Notice: Subject to any disclaimer, the term of this patent is extended or adjusted under 35 U.S.C. 154(b) by 946 days.

(21) Appl. No.: 10/794,981

(22) Filed: Mar. 4, 2004

(65) Prior Publication Data

US 2004/0214629 A1 Oct. 28, 2004

Related U.S. Application Data

(60) Provisional application No. 60/452,164, filed on Mar. 4, 2003.

(51) Int. Cl.
*A63F 9/24* (2006.01)

(52) U.S. Cl. ..... 463/20; 463/16; 463/17; 463/18; 463/19; 463/25

(58) Field of Classification Search ..... 463/16–20, 463/21, 25

See application file for complete search history.

(56) References Cited

U.S. PATENT DOCUMENTS 5,092,598 A 3/1992 Kamille
5,123,649 A 6/1992 Tiberio
5,511,781 A 4/1996 Wood et al.
5,611,729 A * 3/1997 Schumacher et al. ..... 463/18
5,833,538 A * 11/1998 Weiss ..... 463/21
5,911,419 A * 6/1999 Delaney et al. ..... 273/292
5,971,850 A 10/1999 Liverance ..... 463/23
5,980,384 A 11/1999 Barrie ..... 463/16
5,997,401 A 12/1999 Crawford
6,004,208 A 12/1999 Takemoto et al. ..... 463/20
6,024,642 A * 2/2000 Stupak ..... 463/20
6,056,642 A 5/2000 Bennett ..... 463/20

(Continued)

FOREIGN PATENT DOCUMENTS

JP 258808 2/1999

OTHER PUBLICATIONS

Bart, Peter, "The Back Lot Gambling on showmanship in virtual Vegas", Daily Variety, Mar. 10, 1997.

(Continued)

*Primary Examiner*—Peter DungBa Vo
*Assistant Examiner*—David Duffy
(74) *Attorney, Agent, or Firm*—K&L Gates LLP

(57) ABSTRACT

In accordance with one or more embodiments, a method for determining a set of game symbols for use in a game based on a state of the game is provided, including determining a payout amount to be provided based on a first amount and a second reel outcome, the payout amount being equal to or less than the first amount; wherein a first probability of at least one first symbol being included in a first outcome is different than a second probability of the at least one first symbol being included in the second outcome, the first and second probabilities being greater than zero.

31 Claims, 13 Drawing Sheets

324

| STATE IDENTIFIER 700 | STATE DESCRIPTION 702 | REEL SET IDENTIFIER 704 |
|---|---|---|
| S-1 | DISCOVERING TREASURE | RS-01 |
| S-2 | OPENING THE CHESTS | RS-02 |
| S-3 | LOADING UP THE TREASURE | RS-03 |
| S-4 | TRANSPORTING THE TREASUE | RS-04 |
| S-5 | UNLOADING THE TREASURE | RS-05 |

326

| REEL SET IDENTIFIER 800 | SYMBOLS OF FIRST REEL 802 | SYMBOLS OF SECOND REEL 804 | SYMBOLS OF THIRD REEL 806 |
|---|---|---|---|
| RS-01 | 3 CHESTS, 2 BEACHES, 4 OCEAN, 3 TELESCOPES, 7 MAPS, 3 BLANKS | 2 CHESTS, 4 BEACHES, 6 OCEAN, 1 TELESCOPE, 3 MAPS, 6 BLANKS | 1 CHEST, 5 BEACHES, 2 OCEAN, 5 TELESCOPES, 2 MAPS, 7 BLANKS |
| RS-02 | 3 CROWBARS, 2 KEYS, 4 GUNPOWDERS, 3 ROCKS, 7 BOARDS, 3 BLANKS | 3 CROWBARS, 2 KEYS, 4 GUNPOWDERS, 3 ROCKS, 7 BOARDS, 3 BLANKS | 2 CROWBARS, 3 KEYS, 4 GUNPOWDERS, 5 ROCKS, 5 BOARDS, 3 BLANKS |
| RS-03 | 3 BOATS, 2 ROPES, 4 PULLEYS, 3 CRATES, 7 WORKERS, 3 BLANKS | 2 BOATS, 2 ROPES, 5 PULLEYS, 1 CRATE, 5 WORKERS, 7 BLANKS | 1 BOAT, 2 ROPES, 5 PULLEYS, 5 CRATES, 5 WORKERS, 3 BLANKS |
| RS-04 | 3 BOATS, 2 STORMS, 4 CANNONS, 3 BARRELS, 7 WINDS, 3 BLANKS | 6 BOATS, 2 STORMS, 1 CANNON, 4 BARRELS, 6 WINDS, 3 BLANKS | 3 BOATS, 2 STORMS, 2 CANNONS, 3 BARRELS, 2 WINDS, 10 BLANKS |
| RS-05 | 3 ROPES, 2 HORSES, 4 BARRELS, 3 CHESTS, 6 WORKERS, 4 BLANKS | 5 ROPES, 2 HORSES, 2 BARRELS, 2 CHESTS, 8 WORKERS, 3 BLANKS | 4 ROPES, 2 HORSES, 3 BARRELS, 7 CHESTS, 4 WORKERS, 2 BLANKS |

U.S. PATENT DOCUMENTS

| | | | | |
|---|---|---|---|---|
| 6,062,980 | A | 5/2000 | Luciano | 463/20 |
| 6,077,163 | A | 6/2000 | Walker et al. | |
| 6,120,378 | A | 9/2000 | Moody et al. | 463/20 |
| 6,203,430 | B1 * | 3/2001 | Walker et al. | 463/20 |
| 6,224,482 | B1 | 5/2001 | Bennett | 463/20 |
| 6,319,127 | B1 | 11/2001 | Walker et al. | |
| 6,375,568 | B1 | 4/2002 | Roffman et al. | 463/26 |
| 6,386,975 | B1 | 5/2002 | Peterson | 463/16 |
| 6,394,902 | B1 | 5/2002 | Glavich et al. | 463/20 |
| 6,406,369 | B1 * | 6/2002 | Baerlocher et al. | 463/20 |
| 6,409,172 | B1 | 6/2002 | Vancura | |
| 6,419,579 | B1 | 7/2002 | Bennett | 463/20 |
| 6,425,824 | B1 | 7/2002 | Baerlocher et al. | |
| 6,464,581 | B1 | 10/2002 | Yoseloff et al. | 463/20 |
| 6,494,785 | B1 | 12/2002 | Gerrard et al. | |
| 6,497,617 | B1 | 12/2002 | Yoshida | 463/20 |
| 6,506,118 | B1 | 1/2003 | Baerlocher et al. | |
| 6,592,457 | B1 | 7/2003 | Frohm et al. | 463/16 |
| 6,612,574 | B1 * | 9/2003 | Cole et al. | 273/138.1 |
| 6,669,559 | B1 | 12/2003 | Baerlocher et al. | |
| 6,682,073 | B2 * | 1/2004 | Bryant et al. | 273/138.1 |
| 6,715,756 | B2 * | 4/2004 | Inoue | 273/143 R |
| 6,731,313 | B1 | 5/2004 | Kaminkow | |
| 6,843,723 | B2 | 1/2005 | Joshi | |
| 6,855,054 | B2 | 2/2005 | White et al. | |
| 6,926,607 | B2 | 8/2005 | Slomiany et al. | |
| 6,939,229 | B2 | 9/2005 | McClintic | |
| 6,981,635 | B1 | 1/2006 | Hughs-Baird et al. | |
| 7,140,964 | B2 | 11/2006 | Walker et al. | |
| 7,314,410 | B2 | 1/2008 | Baerlocher et al. | |
| 7,384,334 | B2 | 6/2008 | Glavich et al. | |
| 7,402,102 | B2 | 7/2008 | Marks et al. | |
| 7,427,233 | B2 | 9/2008 | Walker et al. | |
| 2002/0052232 | A1 | 5/2002 | Kaminkow | |
| 2003/0040355 | A1 * | 2/2003 | Baerlocher | 463/20 |
| 2003/0045344 | A1 * | 3/2003 | Webb et al. | 463/20 |
| 2003/0220138 | A1 | 11/2003 | Walker et al. | |
| 2004/0162134 | A1 | 8/2004 | Walker et al. | |
| 2004/0171419 | A1 | 9/2004 | Walker et al. | |
| 2004/0242319 | A1 | 12/2004 | Walker et al. | |
| 2005/0250578 | A1 | 11/2005 | Slomiany et al. | |
| 2007/0184894 | A1 | 8/2007 | Baerlocher | |

OTHER PUBLICATIONS

Grochowski, John, "Future slots: an Odyssey", Chicago Sun-Times, Nov. 2, 1997, Section: Show; Casino, p. 18, NC.

"Silicon Gaming Receives Approval to Release Four New Games in Nevada; $1 and $5 Denomination Options for Odyssey™", PR Newswire, Feb. 17, 1998, Section: Financial News.

"A game to get your motor running", Coinslot Casino Review, Jan. 2003, p. 14, section: product news.

Website: "5 Reel Slot Machine Review—Bucaneers Bounty", (http //www allonlineslots com/buccaneersb htm), download date: Mar. 11, 2003.

Website: "Broadside—Themed adventure game", (http //www goodasgoldcasino com/games asp), download date: Mar. 11, 2003.

"A.C. Coin & Slot Staying Power", Global Gaming Business, Sep. 15, 2002, p. 42.

Cook, Melissa, "The Best New Slots", Casino Player Magazine, Apr. 1998, p. 45.

Website: "Casino Journal World of Slots AC Coin—Tthe Interactive Experience", (http://www.casinocenter.com/journal/oct97/html/ac_coin.html), download date: Jun. 4, 1998.

Website: "Press Your Luck (PYL) General Information Page", (http//members.fortunecity.com/jd83/pylinfo.html), undated.

* cited by examiner

318

| RANDOM NUMBER 400 | OUTCOME 402 |
|---|---|
| 0 TO 10 | BAR, BAR, BAR |
| 11 TO 1,000 | CHERRY, CHERRY, CHERRY |
| 1,001 TO 1,000,000 | ANY, ANY, ANY |

FIG. 4

320

| OUTCOME 500 | PAYOUT 502 |
|---|---|
| BAR, BAR, BAR | 100 |
| CHERRY, CHERRY, CHERRY | 10 |
| ANY, ANY, ANY | 0 |

FIG. 5

322

| PARAMETER TYPE 600 | PARAMETER VALUES 602 | PARAMETER VALUE PROBABILITY 604 | CURRENT VALUE 606 | TERMINATING VALUE 608 |
|---|---|---|---|---|
| CARROTS | 8 | 10% | 5 | 0 |
| | 10 | 40% | | |
| | 12 | 40% | | |
| | 15 | 10% | | |
| ACES | 1 | 10% | 0 | 1 |
| | 2 | 80% | | |
| | 3 | 10% | | |

FIG. 6A

322

| PARAMETER TYPE 650 | CURRENT VALUE 652 |
|---|---|
| CAR SPEED | 170 |
| # OF CHESTS | 6 |
| TOTAL TREASURE VALUE | 118 |

FIG. 6B

324

| STATE IDENTIFIER 700 | STATE DESCRIPTION 702 | REEL SET IDENTIFIER 704 |
|---|---|---|
| S-1 | DISCOVERING TREASURE | RS-01 |
| S-2 | OPENING THE CHESTS | RS-02 |
| S-3 | LOADING UP THE TREASURE | RS-03 |
| S-4 | TRANSPORTING THE TREASUE | RS-04 |
| S-5 | UNLOADING THE TREASURE | RS-05 |

FIG. 7

326

| REEL SET IDENTIFIER 800 | SYMBOLS OF FIRST REEL 802 | SYMBOLS OF SECOND REEL 804 | SYMBOLS OF THIRD REEL 806 |
|---|---|---|---|
| RS-01 | 3 CHESTS, 2 BEACHES, 4 OCEAN, 3 TELESCOPES, 7 MAPS, 3 BLANKS | 2 CHESTS, 4 BEACHES, 6 OCEAN, 1 TELESCOPE, 3 MAPS, 6 BLANKS | 1 CHEST, 5 BEACHES, 2 OCEAN, 5 TELESCOPES, 2 MAPS, 7 BLANKS |
| RS-02 | 3 CROWBARS, 2 KEYS, 4 GUNPOWDERS, 3 ROCKS, 7 BOARDS, 3 BLANKS | 3 CROWBARS, 2 KEYS, 4 GUNPOWDERS, 3 ROCKS, 7 BOARDS, 3 BLANKS | 2 CROWBARS, 3 KEYS, 4 GUNPOWDERS, 5 ROCKS, 5 BOARDS, 3 BLANKS |
| RS-03 | 3 BOATS, 2 ROPES, 4 PULLEYS, 3 CRATES, 7 WORKERS, 3 BLANKS | 2 BOATS, 2 ROPES, 5 PULLEYS, 1 CRATE, 5 WORKERS, 7 BLANKS | 1 BOAT, 2 ROPES, 5 PULLEYS, 5 CRATES, 5 WORKERS, 3 BLANKS |
| RS-04 | 3 BOATS, 2 STORMS, 4 CANNONS, 3 BARRELS, 7 WINDS, 3 BLANKS | 6 BOATS, 2 STORMS, 1 CANNON, 4 BARRELS, 6 WINDS, 3 BLANKS | 3 BOATS, 2 STORMS, 2 CANNONS, 3 BARRELS, 2 WINDS, 10 BLANKS |
| RS-05 | 3 ROPES, 2 HORSES, 4 BARRELS, 3 CHESTS, 6 WORKERS, 4 BLANKS | 5 ROPES, 2 HORSES, 2 BARRELS, 2 CHESTS, 8 WORKERS, 3 BLANKS | 4 ROPES, 2 HORSES, 3 BARRELS, 7 CHESTS, 4 WORKERS, 2 BLANKS |

FIG. 8

328

| EVENT IDENTIFIER 900 | EVENT TYPE 902 | STAGE 1 PROBABILITY 904 | STAGE 2 PROBABILITY 906 |
|---|---|---|---|
| EVENT-62 | FLAT TIRE | 1 IN 100 SPINS | 1 IN 50 SPINS |
| EVENT-64 | RAIN SHOWER | 10% | 5% |
| EVENT-66 | OIL SLICK | 0% | 45% |
| EVENT-68 | TURBO BOOST | 1 IN 30 SPINS | 1 In 1,500 SPINS |
| EVENT-70 | DOWN HILL | 50% | 35% |

FIG. 9

330

| EVENT IDENTIFIER 1000 | FIRST SYMBOL 1002 | FIRST SYMBOL IDENTIFIER 1004 | SECOND SYMBOL 1006 | SECOND SYMBOL IDENTIFIER 1008 | EVENT DESCRIPTION 1010 |
|---|---|---|---|---|---|
| EVENT-02 | TREASURE CHEST | 1-0001 | KEY | 2-0001 | OPEN CHEST; DETERMINE RANDOM TREASURE VALUE OF 5 - 75 COINS |
| EVENT-04 | TREASURE CHEST | 1-0002 | CROWBAR | 2-0002 | PAYOUT 50 CREDITS |
| EVENT-06 | TREASURE MAP | 1-0003 | SHOVEL | 2-0003 | PAYOUT RANDOM # OF 1-100 CREDITS |
| EVENT-08 | N/A | N/A | GOOD WIND | 2-0004 | MOVE SHIP 2 SPACES FORWARD |
| EVENT-10 | PIRATE | 1-0004 | N/A | N/A | LOSE 1 TREASURE CHEST |

FIG. 10

METHOD AND APPARATUS FOR ASSOCIATING SYMBOLS WITH A STATE OF A GAMING DEVICE

The present Application:

claims the benefit of priority of U.S. Provisional Application No. 60/452,164, filed Mar. 4, 2003, entitled "METHOD AND APPARATUS FOR ASSOCIATING SYMBOLS WITH A STATE OF A GAMING DEVICE"

The entirety of the above application is incorporated by reference herein for all purposes.

CROSS-REFERENCE TO RELATED APPLICATIONS

This application is related to the following commonly-owned and applications:

(i) U.S. patent application Ser. No. 10/792,014, filed Mar. 3, 2004, entitled "METHOD AND APPARATUS FOR BOUNDING PLAY GE A GAMING DEVICE"; which claims the benefit of priority of U.S. Provisional Patent Application No. 60/451,969, filed Mar. 4, 2003;

(ii) U.S. patent application Ser. No. 10/784,845, filed Feb. 23, 2004 which issued as U.S. Pat. No. 7,427,233 on Sep. 23, 2008, entitled "METHOD AND APPARATUS FOR SETTING GAME PARAMETERS"; which claims the benefit of U.S. Provisional Patent Application No. 60/449,270, filed Feb. 21, 2003;

(iii) U.S. patent application Ser. No. 10/001,089, filed Nov. 2, 2001 which issued as U.S. Pat. No. 7,140,964 on Nov. 28, 2006, entitled "GAMING DEVICE FOR A FLAT RATE PLAY SESSION AND METHOD OF OPERATING SAME"; which (a) claims the benefit of U.S. Provisional Patent Application No. 60/282,792, filed Apr. 10, 2001, entitled "GAMING CONTRACTS"; and (b) is a continuation-in-pad of U.S. patent application Ser. No. 09/518,760, filed Mar. 3, 2000, entitled "GAMING DEVICE FOR A FLAT RATE PLAY SESSION AND METHOD OF OPERATING SAME," issued on Nov. 20, 2001, as U.S. Pat. No. 6,319,127 B1; which is a continuation of U.S. patent application Ser. No. 08/880,838, filed Jun. 23, 1997, entitled "GAMING DEVICE FOR A FLAT RATE PLAY SESSION AND A METHOD OF OPERATING SAME," issued on Jun. 20, 2000, as U.S. Pat. No. 6,077,163; and (iv) U.S. patent application Ser. No. 10/778,576, filed Feb. 13, 2004 now abandoned, entitled "METHOD AND APPARATUS FOR ENHANCED PLAY OF A GAMING DEVICE"; which:

(a) is a continuation-in-part of U.S. patent application Ser. No. 10/772,837, filed Feb. 5, 2004, entitled ELECTRONIC AMUSEMENT DEVICE AND METHOD FOR ENHANCED SLOT MACHINE PLAY";

(b) is a continuation-in-pan of U.S. patent application Ser. No. 09/716,918, filed Nov. 20, 2000, entitled "ELECTRONIC AMUSEMENT DEVICE AND METHOD FOR ENHANCED SLOT MACHINE PLAY"; which is a continuation of U.S. patent application Ser. No. 09/164,473, filed Oct. 1, 1998) entitled "ELECTRONIC AMUSEMENT DEVICE AND METHOD FOR ENHANCED SLOT MACHINE PLAY," which issued as U.S. Pat. No. 6,203,430 B1 on Mar. 20, 2001; and (c) claims the benefit of priority of U.S. Provisional Application Nos. 60/447,265 and 60/447,350, both filed on Feb. 13, 2003.

The entirety of each of the above applications is incorporated by reference herein for all purposes.

This application is related to commonly owned earlier filed, Provisional Patent Application Ser. No. 60/451,969 filed Mar. 4, 2003, entitled "METHOD AND APPARATUS FOR BOUNDING PLAY OF A GAMING DEVICE"; which is incorporated herein by reference in its entirety for all purposes.

FIELD OF THE INVENTION

The present invention relates to gaming and gaming devices.

BACKGROUND

Gaming devices (e.g., reeled slot machines, video poker machines) generate more than $15 billion per year in revenue for casinos in the United States alone. This figure accounts for more than half of the gaming revenue for a typical United States casino. The situation is similar in other countries and regions in which gaming devices are popular, such as Australia and Europe. Accordingly, casino operators are interested in increasing the enjoyment of playing gaming devices in order to maintain or increase this level of revenue.

Since casino profits are directly proportional to the amount wagered by patrons, casinos are highly motivated to expand and retain share within their given market. Increased playing duration, average wager, and rates of play by players are all factors that contribute to the profitability of the slot floor of a casino.

One way in which casinos have sought to boost profitability associated with such factors is to make the machines as entertaining as possible. Many techniques are currently used to entertain players at a slot machine, such as attractive colors and graphics, sound effects associated with winning payouts, and jackpots or bonus rounds that offer players the chance to win a large amount of money for only a small wager. While such efforts have made modern slot machines more entertaining than the previous generation of machines, entertainment options open to consumers have been expanding as well. Casinos now compete not only with the casino across the street, but with alternative player entertainment options such as home theater systems, handheld video game devices, greatly expanded television and movie offerings, and the like.

Accordingly, a need exists for enhancing the entertainment value of gaming devices.

BRIEF DESCRIPTION OF THE FIGURES

The accompanying drawings depict some exemplary embodiments of the present invention:

FIG. 4 is a table illustrating an example data structure of a probability database for use in some embodiments of the present invention;

FIG. 5 is a table illustrating an example data structure of a payout database for use in some embodiments of the present invention;

FIG. 6A is a table illustrating an example data structure of a parameter value database for use in some embodiments of the present invention;

FIG. 6B is a table illustrating another example data structure of a parameter value database for use in some embodiments of the present invention;

FIG. 7 is a table illustrating an example data structure of a game state database for use in some embodiments of the present invention;

FIG. 8 is a table illustrating an example data structure of a reel symbol database for use in some embodiments of the present invention;

FIG. 9 is a table illustrating an example data structure of an event probability database for use in some embodiments of the present invention;

FIG. 10 is a table illustrating an example data structure of an event database for use in some embodiments of the present invention;

DETAILED DESCRIPTION

Figure 1:
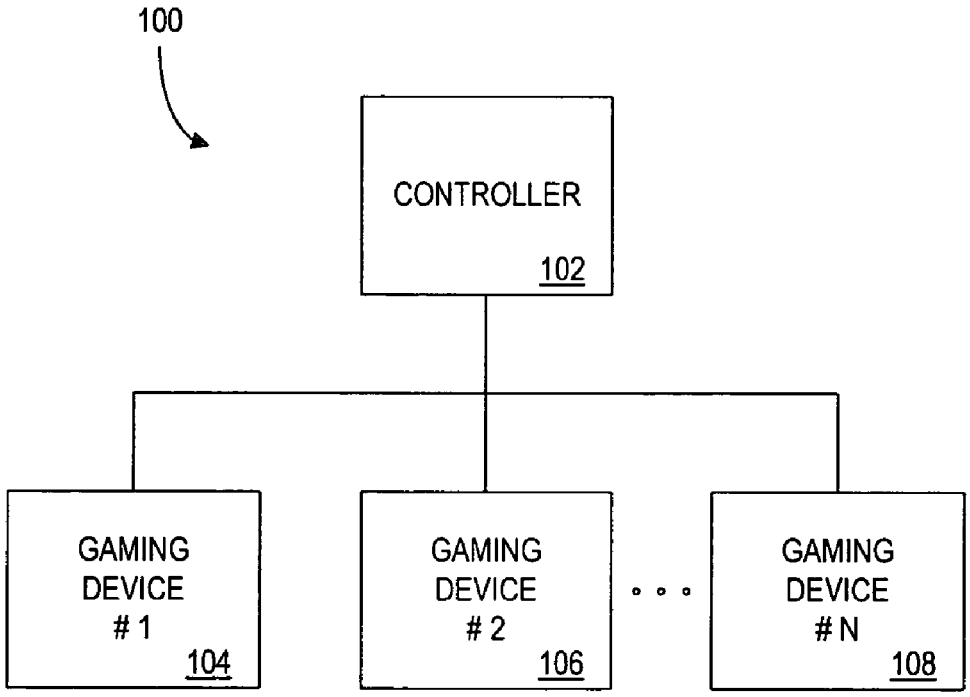
FIG. 1 is a block diagram illustrating an example system according to some embodiments of the present invention.

Some types of games and gaming devices are capable of operating in more than one state or stage. For example, some types of games begin with play in a first stage of the game (e.g., a basic slot machine game, a first portion of a race game). Play may then proceed to another stage of the game (e.g., a bonus game, a second portion of a race game).

According to various embodiments of the present invention, appropriate probabilities associated with game events, game symbols and/or payouts may be selected based on the particular stage or state of the slot machine. For example, the probability of a game event or game outcome occurring may vary from state to state.

In one or more embodiments of the present invention, a gaming device is able to select a probability (or set of probabilities) for one or more outcomes or other game events, based on the particular stage or state of the gaming device. These probabilities (e.g., as represented in a probability table) then may be used to determine outcomes or other game events for the player. The game events are thus tailored to the particular stage or state of the gaming device. For instance, an outcome (e.g., a cherry symbol appearing on a slot machine payline) or game event (e.g., a flat tire occurring in a race game) may be more likely in one stage of a game (e.g., a basic slot machine game, a first portion of a race game) and may be less likely (or impossible) during another stage of the game (e.g., a bonus game, a second portion of a race game).

One or more embodiments of the present invention allow a slot machine to select a set of reel symbols based on the particular stage or state of the slot machine. Selected reel symbol sets then may be used in representing outcomes (e.g., a result of a reel spin) to the player that are thus tailored to the particular stage or state of the slot machine. An outcome that may be possible in one stage of the slot machine game (e.g., a treasure locating stage) may not be possible (or may be less likely) in another stage of the game (e.g., a treasure transporting stage).

Some embodiments of the present invention allow for interaction (and other types of relationships) between at least one symbol of a first symbol set (e.g., of a first stage) and at least one symbol of a second symbol set (e.g., of a second stage). In one example, a first symbol is collected during a first stage when it appears on a payline (e.g., after a handle pull). A representation of the first symbol (e.g., a treasure chest) is displayed at a secondary game screen. During a second stage, a second symbol (e.g., a key) appears in a reel outcome. At some point in the game (e.g., when the second symbol appears, at the end of the second stage), the second symbol interacts with or operates on the first symbol. For example, a key may be used to attempt to open a collected treasure chest. For instance, based on a probability of the key opening the chest, a credit value may be revealed. In some embodiments, the player may receive the credit value immediately. In other embodiments, the revealed value may still be at risk—in other words, the player may receive none or only some of the revealed value (e.g., based on subsequent game events and/or reel outcomes). Various types of appropriate information may be stored about a first symbol and an associated second symbol, such as, without limitation: (i) an indication of the type of relationship between the first symbol and the second symbol; (ii) an indication of possible outcomes, payouts, and/or events resulting from interaction of the two symbols (or operation of one symbol on another); and (iii) an indication of the probability of each possible result of interaction.

One or more embodiments of the present invention allow a video poker machine to select a set of cards based on the particular stage or state of the machine. The selected card set then may be used in representing outcomes (e.g., a hand dealt to a player) that are thus tailored to the particular stage or state of the machine. An outcome that may be possible in one stage of the video poker game (e.g., a "Go Wild!" stage using a deck with multiple "wild" cards may allow for five-of-a-kind) may not be possible (or may be less likely) in another stage of the game (e.g., a stage using a standard deck of playing cards). Of course, various types of card games other than poker may be provided in accordance with the present invention.

Some embodiments of the present invention provide for a game that allows a player to play a basic game (e.g., involving reel spins and outcomes). Play of the basic game affects a parameter value (e.g., a running count of accumulated symbols, a maximum potential payout value). The parameter value, however, is also affected by one or more independent random game events whose occurrence is not directly related to the outcomes in the basic game (e.g., their occurrence is independent of the result of any handle pull in the basic game). Preferably, the occurrence of these random events is not related to activities of other players or other gaming devices (in contrast to progressive jackpots, for example).

In one example, fruit game symbols received in reel outcomes in a slot machine game may increase a stored tally of collected fruit symbols. The running count of fruit symbols is tracked over multiple handle pulls (and possibly over multiple stages of the game). While the player is making handle pulls, however, independent random game events may occur that reduce the number of collected fruit symbols (e.g., by causing the fruit to "expire" or be "stolen" by a game character). In a variation of this example game, other game symbols (e.g., non-fruit symbols) appearing in reel outcomes may reduce the count of collected fruit symbols (e.g., a "frost" symbol may eliminate some of the collected fruit), or "protect" the fruit symbols from expiring (e.g., a "jar" symbol is acquired).

In some embodiments, the probability of a particular independent game event occurring may vary from one stage of the game to another. Referring to the fruit game example above, the likelihood of losing fruit might increase as the game continues. For instance, the game may progress from a "summer" stage to a "winter" stage, with the fruit being more likely to expire during the "winter" stage.

According to some embodiments, determining whether a game event has occurred may include using a first set of probabilities (e.g., as stored in a probability database) in a first stage, and a second set of probabilities during a second stage. In some embodiments, a payout may be determined based on the parameter value (e.g., at the end of the game session).

Some embodiments of the present invention may be useful for gaming devices which offer prepaid sessions or packages of spins for a flat rate price. Some types of games may have a story line or plot line, and the gaming device may change from one stage to the next as the spins take place. Some examples of such games are described herein.

Various embodiments of the present invention are described herein with reference to the accompanying drawings. The leftmost digit(s) of a reference numeral typically identifies the figure in which the reference numeral first appears.

In the following description, reference is made to the accompanying drawings that form a part hereof, and in which are shown, by way of illustration, specific embodiments in which the invention may be practiced. These embodiments are described in sufficient detail to enable those skilled in the art to practice the invention. It will be understood that other embodiments may be utilized and that structural, logical, software, and electrical changes may be made without departing from the scope of the present invention. The following description is, therefore, not to be taken in a limited sense, and the scope of the present invention is defined by the appended claims.

Throughout the description that follows and unless otherwise indicated, the following terms may include and/or encompass example meanings described herein. These terms and illustrative example meanings are provided to clarify the language selected to describe embodiments of the invention both in the specification and in the appended claims.

The term "basic game" may refer to play resulting from the spinning of standard physical or graphical slot reels, the dealing of physical or electronic cards, or other game outcomes. The outcome of a basic game might be cherry-cherry-bar; four hits on a seven-spot keno ticket; or the hand of Ks (king of spades), Qd (queen of diamonds), 4h (four of hearts), 2s (two of spades), 6s (six of spades) in video poker.

The term "bonus game" may refer to a secondary game separate from the basic game in which the player typically does not have to wager any additional coins and has the possibility of winning a relatively large number of coins. In one example, a bonus game depicted on a secondary display screen persists while a basic game is played on a primary display screen.

The term "game play parameter" may refer to variables whose values govern aspects of play at the gaming device, exclusive of variables directly related to payout amounts, pay table selection, and payout probabilities. The value of a game play parameter may be determined, for example, by a random selection process, or may be selected by a player. Examples include the number of bar symbols that a player must collect, the number of cherry symbols collected by a player that are still remaining (e.g., in a game in which collected symbols may be lost or stolen); the number of handle pulls for which a bonus mode will remain active, the probability of a game character appearing on a given handle pull, a maximum number of hearts a player is allowed to be dealt in a poker game, and a maximum number of losing outcomes a player is allowed in a game session.

The term "game parameter" may refer to variables whose values govern play at the gaming device and may be determined, for example, by player selection or by a random selection process. Game parameters include game play parameters. Examples of game parameters include the payout for bar-bar-bar, the number of cherry symbols on the first reel, and the probability of a game character finding hidden treasure.

The term "game parameter value" may refer to a value (or set of values) associated with a game parameter, such as two hundred coins, twelve cherry symbols, or a 30% chance of finding treasure. Game parameter values include terminating values.

The term "terminating value" may refer to a value (or set of values) associated with a game parameter. If the game parameter attains a terminating value, play of a gaming device, game, game stage, or game session may be terminated. For example, one type of game may allow a player to keep making reel spins (e.g., without making per-spin wagers) until three or more "Poison" reel symbols have appeared. If a game play parameter is used to track the number of "Poison" reel symbols that have appeared on the payline, then the corresponding terminating value would be three.

The term "game parameter value symbol" may refer to a reel symbol that represents a game parameter value, such as a reel symbol displaying "200 coins" or "12 cherry symbols." The symbol could also be found on other representations of random events such as spinners, which could be located, for example, on a secondary screen.

The term "controller" may refer to an electronic device (e.g., a personal computer) that communicates with one or more gaming devices. In a manner well known in the art, a controller may function as a computer server and may control the actions of gaming devices. A controller may also contain databases to record statistics such as coin-in, coin-out, jackpot information, theoretical wins, etc.

The term "game" may refer to a gambling event or activity with a beginning and an end. The activity may encompass and/or may be defined by a number of spins and/or period of time. Some games may have a beginning and/or an end that is defined by a rule, condition, or is triggered. The beginning or end of a game may be indefinite, indeterminate, or variable. For example, a game may end when a game parameter has a particular value (e.g., when the player runs out of a particular collected game symbol), but exactly what time the game will end (e.g., when the parameter will have that particular value), and/or how many spins the game may encompass, may be indefinite. Of course, the end of some types of such games, even if indefinite or not yet determined, may be statistically predictable. The end of a game may be determined voluntarily (i.e., the player elects to stop play) and/or involuntarily (i.e., the player does not elect to stop play), such as by a gaming device or controller. Some types of games may have more than one state or stage (e.g., a first stage involving a first set of reel symbols and a second stage involving a second set of reel symbols; a basic game stage and a bonus game stage).

The terms "session," "game session," "gaming session," and "play session" shall be synonymous and may refer to a series of plays, game stages, and/or games. Play during a gaming session may take place at one gaming device, at multiple gaming devices, and/or during a continuous period of time (e.g., in a casino location). As with a game, a gaming session may end voluntarily or involuntarily. The end of a game session, as discussed herein, may be defined, for example, by a number of handle pulls, by a period of time, by the accomplishment of one or more objectives, by the occurrence of a trigger or event, by the satisfaction of one or more conditions, and/or by a game parameter becoming associated with a particular value (e.g., a terminating value). A session might be purchased by means of purchasing a contract from a casino, wherein the contract specifies terms such as, for example, a price to be paid by the purchaser for the contract, a duration of play of a gaming device, and a threshold of credits above which the player may collect winnings from a gaming device. Apparatus and methods which, among other things, permit and enable various ways of providing contract play and game sessions such as prepaid sessions, flat rate play sessions, and which are appropriate for use in accordance with the present invention are disclosed in pending U.S. patent application Ser. No. 10/001,089, filed Nov. 2, 2001, entitled "GAME MACHINE FOR A FLAT RATE PLAY SESSION AND METHOD OF OPERATING SAME," the entirety of which is incorporated herein by reference for all purposes.

The term "flat rate play session" may refer to a game session that is associated with a flat rate price. For example, a player may be able to play a desired number of handle pulls for a set price. In another example, a player's flat rate play session is not defined by time or by handle pulls, and will not end until some terminating condition has occurred (e.g., the player receives a flush in a video poker game).

The term "prepaid session" may refer to a period of time and/or a number of plays paid for in advance. The period of time and/or the number of plays may but need not be pre-established. For example, as discussed herein, some types of game sessions may not be defined by time or by a number of handle pulls. Once a session is prepaid, the player typically does not need to supply any additional finds until the session has completed. A prepaid session may allow the player to complete many games (including any number of basic and/or secondary games) and/or handle pulls during the session.

The term "game character" may refer to a character, which may be a cartoon and/or digitally generated, which is involved in the game playing experience. The character may entertain the player, explain payouts, try to steal objects from the player, try to defend objects held by the player, and the like. The character could be a life-like animation of a television character, or even just the audio associated with a well-known character.

The term "gaming device" may refer to any electrical, mechanical, or electromechanical device that, in a manner well known in the art, accepts wagers, steps through a process to determine an outcome, and pays winnings based on the outcome. The outcome may be randomly generated, as with a slot machine; may be generated through a combination of randomness and player skill, as with video poker; or may be generated entirely through player skill. Gaming devices may include slot machines (both video and mechanical reels), video poker machines, video blackjack machines, video roulette machines, video keno machines, video bingo machines, pachinko machines, video lottery terminals, handheld gaming devices, and the like.

The term "handle pull" may refer to a single play at a gaming device whether or not a handle is involved in the play and whether or not a handle is even included in the gaming device. The meaning is intended to be flexible in that a single handle pull might constitute a single complete game, or a single wager. For example, a handle pull might represent a single spin of the reels or a series of spins which culminate in a final aggregate outcome. In a video poker embodiment, handle pulls may result in a first and second hands, both in the same game.

The term "outcome" may refer to a result of gaming event, such as cherry-cherry-cherry in a slot machine game, a push in blackjack, a flush in video poker, the completion of a puzzle, the attainment of a goal, etc. Different types of gaming devices may have widely varying types of outcomes. Several are described in detail herein and still others will be apparent to those of skill in the art based on the present disclosure.

The term "payout" may refer to a prize, reward, winnings, or bonus associated with a certain outcome.

The term "peripheral device" may refer to a device operatively connected to a gaming device that is configured to assist in the operation of game-related functions. In some embodiments peripheral devices may be located near players at a table game.

The term "player tracking card" may refer to a casino issued plastic or paper card (resembling a frequent shopper card) given to players as a way of identifying the player at a slot machine or table game. As is well known in the art, such cards typically have encoded thereon (in machine-readable and/or human readable form) a player identifier (e.g., a six digit number) which uniquely identifies the player (e.g., because the number is associated with a record in a database that includes corresponding player information). At a slot machine, the player inserts the card into a reader device and the player identifier is read from the card, most often magnetically. From the player identifier which the reader device reads, the corresponding player information may in turn be read from the database, typically via a network connection between the reader device and a device hosting the database.

The term "primary game screen" may refer to a screen used to display game information such as a video representation of one or more spinning reels.

The term "secondary game screen" may refer to a screen used to display secondary game information such as the animation and graphics associated with a bonus round.

1. System

An example embodiment of the system 100 of the present invention is depicted in FIG. 1. The present invention can be configured to work as a system 100 in a network environment including a controller 102 (e.g., a slot server of a casino) that is in communication, via a communications network, with one or more gaming devices 104, 106, 108 (e.g., slot machines, video poker machines). The controller 102 may communicate with the gaming devices directly or indirectly, via a wired or wireless medium such as the Internet, LAN, WAN or Ethernet, Token Ring, or via any appropriate communications means or combination of communications means. Each of the gaming devices 104, 106, 108 may comprise computers, such as those based on the Intel® Pentium® processor, that are adapted to communicate with the controller 102. Any number and type of devices 104, 106, 108 may be in communication with the controller 102.

Communication between the devices 104, 106, 108 and the controller 102, and among the devices 104, 106, 108, may be direct or indirect, such as over the Internet through a Web site maintained by computer on a remote server or over an on-line data network including commercial on-line service providers, bulletin board systems and the like. In yet other embodiments, the devices 104, 106, 108 may communicate with one another and/or the controller 102 over RF, cable TV, satellite links and the like.

Some, but not all, possible communication networks that may comprise the network or be otherwise part of the system 100 include: a local area network (LAN), a wide area network (WAN), the Internet, a telephone line, a cable line, a radio channel, an optical communications line, and a satellite communications link. Possible communications protocols that may be part of the system include: Ethernet (or IEEE 802.3), SAP, ATP, Bluetooth™, and TCP/IP. Communication may be encrypted to ensure privacy and prevent fraud in any of a variety of ways well known in the art.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for weeks at a time.

In some embodiments, a controller 102 may not be necessary and/or may not be preferred. For example, the present invention may, in one or more embodiments, be practiced on a stand-alone gaming device 104 and/or a gaming device 104 in communication only with one or more other gaming devices 106, 108. In such embodiments, any functions described as performed by the controller 102 or data described as stored on the controller 102 may instead be performed by or stored on one or more gaming devices 104, 106, 108.

In operation, the controller 102 and the gaming devices 104 may exchange information about the use of the gaming devices 104 by individual players, data about the players, messages, information about parameters, and the like. In embodiments with a third-party server, the controller 102 and/or the gaming devices 104 may exchange information about the use of the gaming devices 104 by individual players, data about the players, messages, parameter information, and the like, via the third-party server. The gaming devices 104 may, for example, provide information related to parameters and conditions to the controller 102 (and/or a third-party server). The gaming devices 104 may further provide gambling performance and player data to the controller 102 (and/or a third-party server). The controller 102 (and/or a third-party server) may provide information about parameters and/or historical information about the player to the gaming devices 104 in the casino location or to remote gaming devices.

It is worthwhile to note that the system 100 (and other systems described herein) may be arranged into a variety of configurations, with functionality residing in various locations. Various types of information may be transmitted between different devices. For example, the controller 102 may control most aspects of determining a symbol set or probability set for a game state. It may determine a game parameter, track the value of a game parameter (e.g., based on game information received from the gaming device 104), and transmit a signal if it determines that a first symbol set should be replaced with a second symbol set. The signal may be received by a gaming device 104, which then switches the symbol sets.

In some embodiments as indicated above, the controller 102 may reside in a gaming device 104. For example, a gaming device 104 may control most aspects of associating probabilities with a particular stage of a game. A gaming device 104 may not even have a network connection. In some embodiments, a game parameter value may be determined by the controller 102, but a gaming device 104 may control when to adjust the probabilities of a game event occurring in a given stage of a game. For example, a gaming device 104 may receive an indication of a terminating value from the controller 102, and the gaming device 104 then monitors play and game parameters during the game session to determine when a game stage should end (e.g., based on a generated outcome, based on the received terminating value), determines the probability of a predefined game event occurring in the next stage, and begins the next stage of the game.

Note that a wide variety of other configurations are possible, some of which are discussed herein. It should be understood that methods of the invention may be implemented by one or more gaming devices 104, one or more controllers 102, other devices, and/or any combination thereof.

Figure 2:
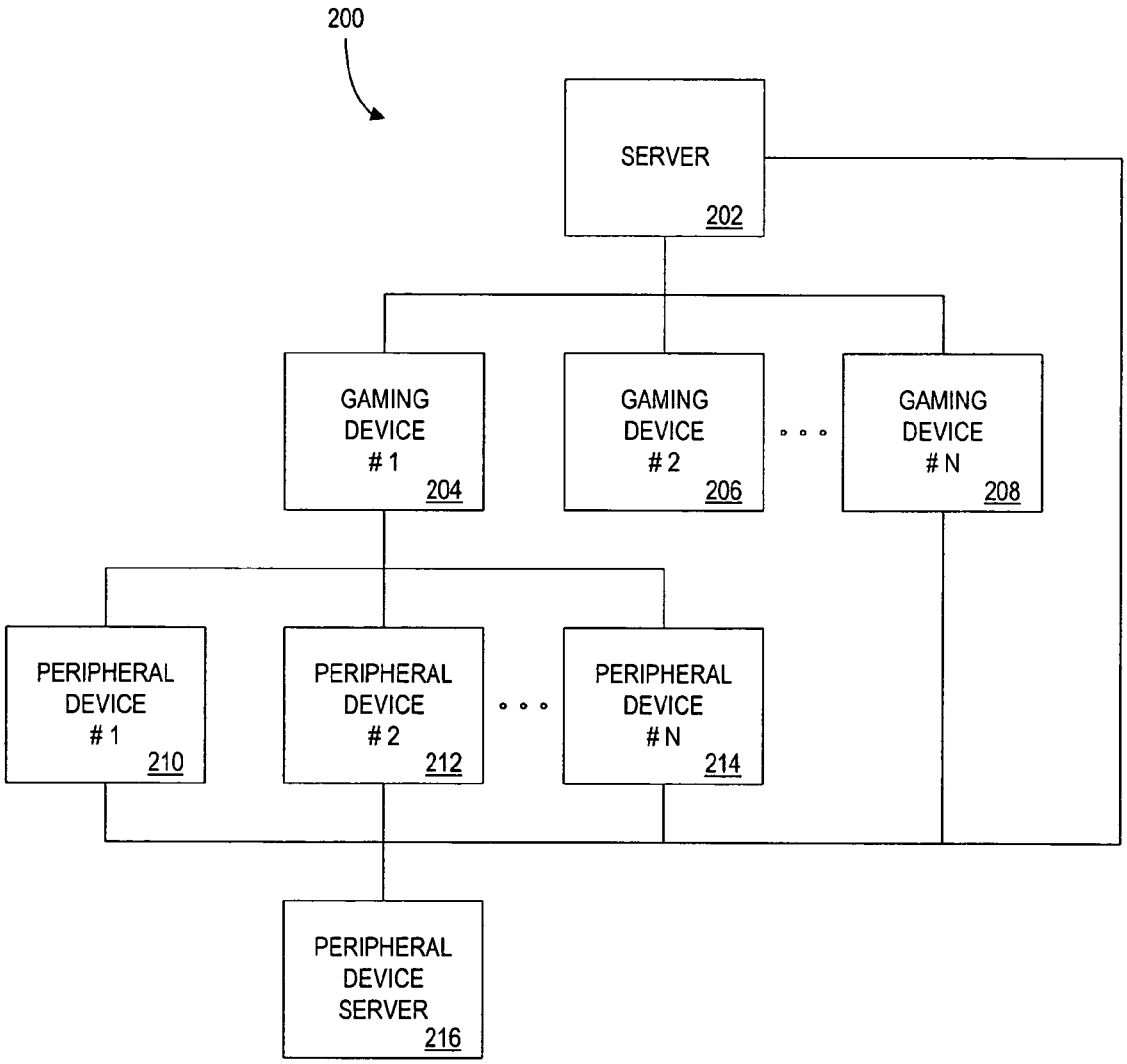
FIG. 2 is a diagram illustrating an example alternative system according to some embodiments of the present invention.

Turning to FIG. 2, an alternative system 200 according to some embodiments of the present invention includes a server 202 (e.g., a slot server of a casino) that is in communication, via a communications network, with one or more gaming devices 204, 206, 208 (e.g., slot machines, video poker machines). A difference between the aforementioned system 100 and this alternative system 200 is that in this system 200 at least one gaming device 204 is also in communication with one or more peripheral devices 210, 212, 214. A peripheral device 210, 212, 214 may, in turn, be in communication with a peripheral device server 216 and, in some embodiments, with the server 202. In some embodiments the peripheral device server 216 may be in communication with one or more gaming devices 204, 206, 208 and/or the server 202.

The server 202 may communicate with the devices 204, 206, 208 and peripherals 210, 212, 214 directly or indirectly, via a wired or wireless medium such as the Internet, LAN, WAN or Ethernet, Token Ring, or via any appropriate communications means or combination of communications means. For example, the server 202 may communicate directly with one of the gaming devices 204, 206, 208 (e.g., via a LAN) and indirectly (e.g., via a gaming device) with a peripheral device 210, 212, 214. In another example, the server 202 may communicate with one of the gaming devices 204 via a LAN and with another of the gaming devices 208 via the Internet (e.g., if the particular gaming device 208 comprises a personal computer in communication with an online casino).

Each of the devices 202, 204, 206, 208, 210, 212, 214, 216 of the system 200 may comprise computers, such as those based on the Intel® Pentium® processor, that are adapted to communicate with the computer. Further, each of the devices 202, 204, 206, 208, 210, 212, 214, 216 may comprise a gaming device such as a mechanical or electronic slot machine, a video poker machine, a video blackjack machine, a video keno machine, a pachinko machine, a video roulette machine, and/or a lottery terminal. Further yet, each of the devices 202, 204, 206, 208, 210, 212, 214, 216 may comprise an external or internal module associated with one or more of the gaming devices 204, 206, 208 that is capable of communicating with one or more of the gaming devices 204, 206, 208 and of directing the one or more gaming devices 204, 206, 208 to perform one or more functions. Any number of devices 204, 206, 208, 210, 212, 214, 216 may be in communication with the server 202. Any number and type of peripheral devices 210, 212, 214 may be in communication with a gaming device 204, peripheral device server 216 and the server 202.

Communication between the devices 204, 206, 208, 210, 212, 214 and the server 202, between each of the devices 204, 206, 208, 210, 212, 214, between the peripheral device server 216 and the devices 204, 206, 208, 210, 212, 214, and between the peripheral device server 216 and the server 202, may be direct or indirect, such as over the Internet through a Web site maintained by the server 202 on a remote server or over an on-line data network including commercial on-line service providers, bulletin board systems and the like. In yet other embodiments, any and all of the devices 204, 206, 208, 210, 212, 214, the server 202, and the peripheral device server 216 may communicate with one another over RF, cable TV, satellite links and the like.

Some, but not all, possible communication networks that may comprise the network or otherwise be part of the system include: a local area network (LAN), a wide area network (WAN), the Internet, a telephone line, a cable line, a radio channel, an optical communications line, a satellite communications link. Possible communications protocols that may be part of the system include: Ethernet (or IEEE 802.3), SAP, ATP, Bluetooth™, and TCP/IP. Communication may be encrypted to ensure privacy and prevent fraud in any of a variety of ways well known in the art.

In some embodiments, the server 202 may not be necessary and/or may not be preferred. For example, the present invention may, in one or more embodiments, be practiced on a stand-alone gaming device 204, one or more gaming devices 204, 206, 208 in communication with one or more peripheral devices 210, 212, 214, one or more gaming devices 204, 206, 208 in communication with a peripheral device server 216, one or more peripheral devices 210, 212, 214 in communication with a peripheral device server 216, and/or a gaming device 208 in communication only with one or more other gaming devices 204, 206. In such embodiments, any functions described as performed by the server 202 or data described as stored in a memory of the server 202 may instead be performed by or stored on one or more gaming devices 204, 206, 208, one or more peripheral devices 210, 212, 214, and/or peripheral device server 216.

Similarly, a peripheral device server 216 may not be desired and/or needed in some embodiments of the present invention. In embodiments that do not involve a peripheral device server 216, any or all of the functions described herein as being performed by a peripheral device server 216 may instead be performed by another server computer, the server 202, one or more gaming devices 204, 206, 208, one or more peripheral devices 210, 212, 214, or a combination thereof. Similarly, in embodiments that do not involve a peripheral device server 216 any data described herein as being stored in a memory of a peripheral device server 216 may instead be stored in a memory of another server computer, the server 202, one or more gaming devices 204, 206, 208, one or more peripheral devices 210, 212, 214, or a combination thereof.

Any or all of the gaming devices 204, 206, 208 may, respectively, include or be in communication with a peripheral device 210. A peripheral device 210 may be a device that receives information from (and/or transmits information to) one or more gaming devices 204, 206, 208. For example, a peripheral device 210 may be operable to receive information about games being played on a gaming device 204, such as the initiation of a game and/or a random number that has been generated for a game.

In one or more embodiments, one or more such peripheral devices 210, 212, 214 may be in communication with a peripheral device server 216. This allows the peripheral device server 216 to receive information regarding a plurality of games being played on a plurality of gaming devices 204, 206, 208. The peripheral device server 216, in turn, may be in communication with the server 202. It should be understood that any functions described herein as performed by a peripheral device 210 may also or instead be performed by the peripheral device server 216. Similarly, any data described herein as being stored on or accessed by a peripheral device 210 may also or instead be stored on or accessed by the peripheral device server 216.

A peripheral device 210 may be operable to access a database (e.g., of a peripheral device server 216) to provide benefits (e.g., cashless gaming receipts) based on, for example, an actual outcome of a game. A peripheral device 210 may be operable to access a probability database to determine a set of probabilities for a new state of a game, based on, for example, a condition for terminating the current state being satisfied.

The peripheral device server 216 may also monitor player gambling history over time by associating gambling behavior with player identifiers, such as player tracking card numbers. For example, information about the player obtained or accessed by a peripheral device server 216 may be analyzed, e.g., to identify those players that a particular gaming machine owner, operator, or manufacturer finds most desirable. Based upon desired objectives, the peripheral device server 216 may direct the appropriate peripheral device 210 to issue customized messages, offers, and games to specific players.

Information received by a peripheral device 210 from a gaming device 204 may include gambling data such as number of games initiated per unit of time, outcomes displayed for games initiated, payouts corresponding to outcomes displayed, a credit meter balance of the gaming device 204, and/or data associated with the player currently playing the gaming device 204.

The functions described herein as being performed by a peripheral device server 216 and/or a peripheral device 210 may, in one or more embodiments, be performed by the server 202 (in lieu of or in conjunction with being performed by a peripheral device server 216 and/or a peripheral device 210).

In some embodiments, a peripheral device 210 may be useful for implementing the embodiments of the present invention into the operation of a conventional gaming device. For example, in order to avoid or minimize the necessity of modifying or replacing a program already stored in a memory of a conventional gaming device, an external or internal module that comprises a peripheral device 210 may be inserted in or associated with a conventional gaming device to transform it into a gaming device 204 of the present invention.

Thus, for example, a peripheral device 210 may be utilized to monitor play of the gaming device 204 and to initiate a new stage of a game (and/or signal that the current stage should be terminated). In such embodiments the gaming device 204 with which the peripheral device 210 is in communication may continue to operate conventionally, for example, by continuing to output an outcome for each handle pull. The peripheral device 210, however, may transmit a signal to prevent any further handle pulls until the player pays for another game session. The peripheral device 210 may also output messages to the player. The peripheral device 210 may also provide benefits to a player (e.g., coins, tokens, electronic credits, paper receipts exchangeable for cash, services, and/or merchandise).

Accordingly, a peripheral device 210 may include (i) a communications port (e.g., for communicating with one or more gaming devices, peripheral device server, another peripheral device, and/or computer); (ii) a display (e.g., for displaying messages and/or outcomes and payouts), (iii) another output means (e.g., a speaker, light, or motion device to communicate with a player), and/or (iv) a benefit providing means (e.g., a printer and paper dispensing means, a credit meter, and/or a hopper and hopper controller).

In some embodiments, a peripheral device 210 may not output outcomes and/or messages to a player but may instead direct the processor 300 of a gaming device 104 to perform such functions. For example, a program stored in a memory of peripheral device 210 may cause a processor 300 of a gaming device 104 to perform certain functions. For example, a program stored in a memory of peripheral device 210 may cause a processor 300 of a gaming device 104 to output an outcome, determine an outcome, output a message, determine an appropriate set of reel symbols, determine an appropriate probability for a game state, terminate a game session, access a database, provide a benefit, refrain from providing a benefit (e.g., by not sending a signal to a hopper controller of the gaming device when it otherwise normally would), and/or communicate with another device.

Examples of peripheral devices 210, 212, 214 include, without limitation, (1) electronic apparatuses "retrofitted" to conventional gaming devices so that inventive processes disclosed herein may be realized through game play at the gaming device 104, (2) Personal Digital Assistants such as those manufactured by Palm, Inc., (3) lap top computers, (4) cellular telephones, (5) pagers, or (6) any combination thereof.

2. Devices

Figure 3:
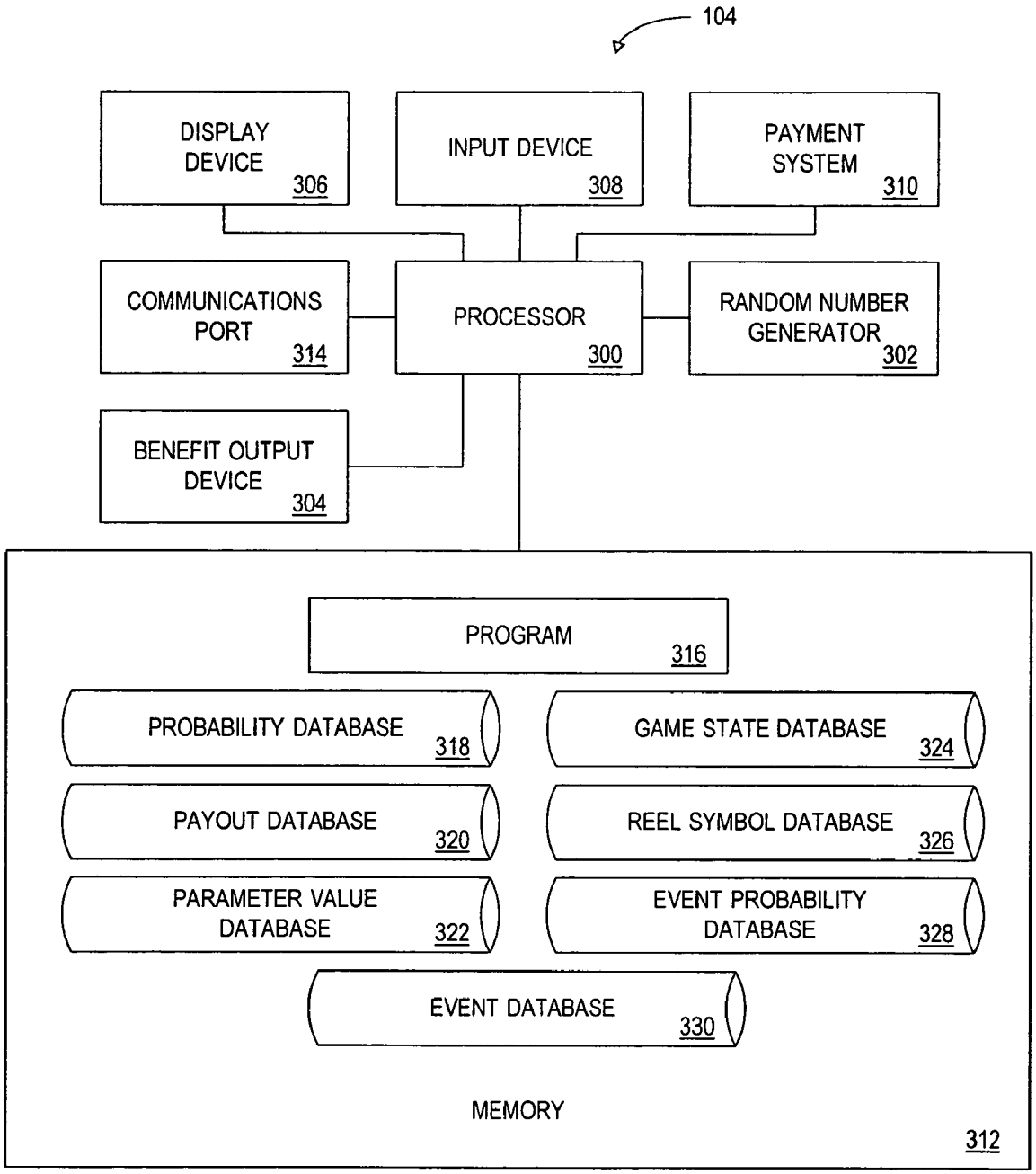
FIG. 3 is a diagram illustrating an example gaming device according to some embodiments of the present invention.

Turning to FIG. 3, a gaming device 104, 204 may be implemented as a system controller, a dedicated hardware circuit, an appropriately programmed general-purpose computer, or any other equivalent electronic, mechanical or electromechanical device. As indicated above, the gaming device 104 may comprise, for example, a slot machine, a video poker machine, a video blackjack machine, a video keno machine, a video lottery machine, a pachinko machine or a table-top game. In various embodiments, a gaming device 104 may comprise, for example, a personal computer (e.g., which communicates with an online casino Web site), a telephone (e.g., to communicate with an automated sports book that provides gaming services), or a portable handheld gaming device (e.g., a personal digital assistant or Nintendo GameBoy®. The gaming device 104 may comprise any or all of the gaming devices of the aforementioned systems. In some embodiments, a user device such as a PDA or cell phone may be used in place of, or in addition to, some or all of the gaming device components. Further, a gaming device 104 may comprise a personal computer or other device operable to communicate with an online casino and facilitate game play at the online casino. In one or more embodiments, the gaming device 104 may comprise a computing device operable to execute software that simulates play of a reeled slot machine game, video poker game, video blackjack game, video keno game, video roulette game, or lottery game.

In some embodiments, a gaming device 104 may comprise a processor 300, such as one or more Intel® Pentium® processors. The processor 300 is operable to communicate with a random number generator 302, which may be a component of the gaming device 104. The random number generator 302, in accordance with some embodiments of the present invention, may generate data representing random or pseudo-random values (referred to as "random numbers" herein). The random number generator 302 may generate a random number every predetermined unit of time (e.g., every thousandth of a second) or in response to an initiation of a game on the gaming device 104. In some embodiments, the generated random numbers may be used as they are generated (e.g., the random number generated at substantially the time of game initiation is used for that game) and/or stored for future use. A random number generated by the random number generator 302 may be used by the processor 300 to determine, for example, at least one of an outcome and payout. A random number generator 302, as used herein, may be embodied as a processor separate from but working in cooperation with the processor 300. Alternatively, the random number generator 302 may be embodied as an algorithm, program component, or software stored in the memory of the gaming device 104 and used to generate a random number.

Note that, although the generation or obtainment of a random number is described herein as involving a random number generator 302 of a gaming device 104, other methods of determining a random number may be employed. For example, a gaming device owner or operator may obtain sets of random numbers that have been generated by another entity. HotBitS™, for example, is a service that provides random numbers that have been generated by timing successive pairs of radioactive decays detected by a Geiger-Muller tube interfaced to a computer. A blower mechanism that uses physical balls with numbers thereon may be used to determine a random number by randomly selecting one of the balls and determining the number thereof.

The processor 300 may also be operable to communicate with a benefit output device 304, which may be a component of gaming device 104. The benefit output device 304 may comprise one or more devices for outputting a benefit to a player of the gaming device. For example, in some embodiments the gaming device 104 may provide coins and/or tokens as a benefit. In such embodiments, the benefit output device 304 may comprise a hopper and hopper controller, for dispensing coins and/or tokens into a coin tray of the gaming device. In another example, the gaming device 104 may provide a receipt or other document on which there is printed an indication of a benefit (e.g., a cashless gaming receipt that has printed thereon a monetary value, which is redeemable for cash in the amount of the monetary value). In such embodiments, the benefit output device 304 may comprise a printing and document dispensing mechanism. In yet another example, the gaming device 104 may provide electronic credits as a benefit (which, e.g., may be subsequently converted to coins and/or tokens and dispensed from a hopper into a coin tray). In such embodiments, the benefit output device 304 may comprise a credit meter balance and/or a processor that manages the number of electronic credits that is indicated on a display of a credit meter balance. In yet another example, the gaming device 104 may credit a monetary amount to a financial account associated with a player as a benefit provided to a player. The financial account may be, for example, a credit card account, a debit account, a charge account, a checking account, or a casino account. In such embodiments, the benefit output device 304 may comprise a device for communicating with a server on which the financial account is maintained.

A benefit output device 304 may comprise, for example, a cashless gaming device which both reads and dispenses tickets, such as the EZ Pay™ device sold by International Game Technology. Such a "ticket-in/ticket-out" device may, for example, be equipped with a thermal ticket printer and/or a bill validator.

Note that, in one or more embodiments, the gaming device 104 may include more than one benefit output device 304. For example, the gaming device 104 may include both a hopper and hopper controller combination and a credit meter balance. Such a gaming device 104 may be operable to provide more than one type of benefit to a player of the gaming device 104. A single benefit output device 304 may be operable to output more than one type of benefit. For example, a benefit output device 304 may be operable to increase the balance of credits in a credit meter and communicate with a remote device in order to increase the balance of a financial account associated with a player.

The processor 300 is also operable to communicate with a display device 306, which may be a component of gaming device 104. The display device 306 may comprise, for example, one or more display screens or areas for outputting information related to game play on the gaming device, such as a cathode ray tube (CRT) monitor, liquid crystal display (LCD) screen, or light emitting diode (LED) screen. In one or more embodiments, a gaming device 104 may comprise more than one display device 306. For example, a gaming device may comprise an LCD display for displaying animated game features and a display area that displays rotating mechanical reels.

The processor 300 may also be in communication with one or more other devices (not pictured) besides the display device 306, for outputting information (e.g., to a player or another device). Such other one or more output devices may also be components of a gaming device 104. Such other one or more output devices may comprise, for example, an audio speaker (e.g., for outputting an outcome or information related thereto, in addition to or in lieu of such information being output via a display device), an infra-red transmitter, a radio transmitter, an electric motor, a printer (e.g., such as for printing cashless gaming vouchers), a coupon or product dispenser, an infra-red port (e.g., for communicating with a second gaming device or a portable device of a player), a Braille computer monitor, and a coin or bill dispenser. For gaming devices 104, common output devices include a cathode ray tube (CRT) monitor on a video poker machine, a bell on a gaming device (e.g., rings when a player wins), an LED display of a player's credit balance on a gaming device, an LCD display of a personal digital assistant (PDA) for displaying keno numbers.

As indicated above, the display device 306 may comprise, for example, one or more display areas. For example, one of the display areas may display outcomes of games played on the gaming device 104 (e.g., electronic reels of a gaming device). Another of the display areas may display rules for playing a game of the gaming device 104. Yet another of the display areas may display the benefits obtainable by playing a game of the gaming device 104 (e.g., in the form of a payout table). In one or more embodiments, the gaming device 104 may include more than one display device 306, one or more other output devices, or a combination thereof (e.g., two display devices 306 and two audio speakers).

The processor may also be in communication with an input device 308, which is a device that is capable of receiving an input (e.g., from a player or another device) and which may be a component of gaming device 104. An input device 308 may communicate with or be part of another device (e.g., a server 202, a gaming device 104, etc.). Some examples of input devices 308 include: a bar-code scanner, a magnetic stripe reader, a computer keyboard or keypad, a button, a handle, a keypad, a touch-screen, a microphone, an infrared sensor, a voice recognition module, a coin or bill acceptor, a sonic ranger, a computer port, a video camera, a motion detector, a digital camera, a network card, a universal serial bus (USB) port, a GPS receiver, a radio frequency identification (RFID) receiver, an RF receiver, a thermometer, a pressure sensor, an infrared port (e.g., for receiving communications from a second gaming device or from a another device such as a smart card or PDA of a player), and a weight scale. For gaming devices 104, common input devices 308 may include a button or touch screen on a video poker machine, a lever or handle connected to the gaming device, a magnetic stripe reader to read a player tracking card inserted into a gaming device, a touch screen for input of player selections during game play, and a coin and bill acceptor.

The processor 300 may also be in communication with a payment system 310, which may be a component of the gaming device. The payment system 310 is a device capable of accepting payment from a player (e.g., a bet or initiation of a balance) and/or providing payment to a player (e.g., a payout). Payment is not limited to money, but may also include other types of consideration, including products, services, and alternate currencies. Exemplary methods of accepting payment by the payment system 310 include (i) receiving hard currency (i.e., coins or bills), and accordingly the payment system 310 may comprise a coin or bill acceptor; (ii) receiving an alternate currency (e.g., a paper cashless gaming voucher, a coupon, a non-negotiable token), and accordingly the payment system may comprise a bar code reader or other sensing means; (iii) receiving a payment identifier (e.g., a credit card number, a debit card number, a player tracking card number) and debiting the account identified by the payment identifier; and (iv) determining that a player has performed a value-added activity (e.g., participating in surveys, monitoring remote images for security purposes, referring friends to the casino).

The processor 300 is in communication with a memory 312 and a communications port 314 (e.g., for communicating with one or more other devices). The memory 312 may comprise an appropriate combination of magnetic, optical and/or semiconductor memory, and may include, for example, Random Access Memory (RAM), Read-Only Memory (ROM), a compact disc and/or a hard disk. The memory 312 may comprise or include any type of computer-readable medium. The processor 300 and the memory 312 may each be, for example: (i) located entirely within a single computer or other device; or (ii) connected to each other by a remote communication medium, such as a serial port cable, telephone line or radio frequency transceiver. In some embodiments, the gaming device 104 may comprise one or more devices that are connected to a remote server computer for maintaining databases.

The memory 312 stores a program 316 for controlling the processor 300. The processor 300 performs instructions of the program 316, and thereby operates in accordance with the present invention, and particularly in accordance with the methods described in detail herein. The program 316 may be stored in a compressed, uncompiled and/or encrypted format. The program 316 furthermore includes program elements that may be necessary, such as an operating system, a database management system and "device drivers" for allowing the processor 300 to interface with computer peripheral devices 302, 304, 306, 308, 310, 312, 314. Appropriate program elements are known to those skilled in the art, and need not be described in detail herein.

The terms "computer-readable medium" or "computer readable media" as used herein may refer to any media or medium that may participate in providing instructions to the processor 300 of the gaming device 104 (or any other processor of a device described herein) for execution. Such a medium may take many forms, including but not limited to, non-volatile media, volatile media, and transmission media. Non-volatile media include, for example, optical or magnetic disks, such as memory. Volatile media include dynamic random access memory (DRAM), which typically constitutes the main memory. Transmission media include coaxial cables, copper wire and fiber optics, including the wires that comprise a system bus coupled to the processor. Transmission media may carry acoustic or light waves, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying one or more sequences of one or more instructions to processor 300 (or any other processor of a device described herein) for execution. For example, the instructions may initially be borne on a magnetic disk of a remote computer. The remote computer can load the instructions into its dynamic memory and send the instructions over a telephone line using a modem. A modem local to a gaming device 104 (or, e.g., a controller 102) can receive the data on the telephone line and use an infrared transmitter to convert the data to an infrared signal. An infrared detector can receive the data carried in the infrared signal and place the data on a system bus for the processor. The system bus carries the data to main memory, from which the processor retrieves and executes the instructions. The instructions received by main memory may optionally be stored in memory either before or after execution by the processor.

In addition, instructions may be received via a communication port 314 as electrical, electromagnetic or optical signals, which are exemplary forms of carrier waves that carry data streams representing various types of information. Thus, the gaming device 104 may obtain instructions in the form of a carrier wave.

According to some embodiments of the present invention, the instructions of the program 316 may be read into a main memory from another computer-readable medium, such from a ROM. Execution of sequences of the instructions in the program 316 causes processor 300 to perform the process steps described herein. In alternate embodiments, hard-wired circuitry may be used in place of, or in combination with, software instructions for implementation of the processes of the present invention. Thus, embodiments of the present invention are not limited to any specific combination of hardware and software. As discussed with respect to aforementioned systems 100, 200, execution of sequences of the instructions in a program 316 of a peripheral device 210 in communication with the gaming device 104 may also cause the processor 300 to perform some of the process steps described herein.

The program 316 may be operative to execute a number of invention-specific, objects, modules and/or subroutines which may include (but are not limited to) one or more routines to identify a player at the gaming device 104; one or more routines to receive information about a user; one or more routines to initiate game sessions; one or more routines to terminate game sessions; one or more routines to determine game parameters; one or more routines for determining terminating and/or initial values of game parameters; one or more routines to adjust the value of game parameters (e.g., based on game events); one or more routines to receive parameter information from a controller 102; one or more routines to receive signals from a controller 102 to adjust parameters; one or more routines to receive signals from a controller 102 to terminate a game session; one or more routines for determining a price for a prepaid or flat rate play session; one or more routines to store player performance information; one or more routines for determining an appropriate symbol set based on a state of a game or the gaming device; one or more routines for determining an appropriate probability of a game event or outcome occurring based on a state of a game or the gaming device; one or more routines to store player preference information; one or more routines to facilitate and control communications between the gaming device 104 and/or third-party servers; one or more routines to restore the gaming device 104 to using its default parameter values; and/or one or more routines to control databases or software objects that track information regarding users, casinos, merchants supplying prizes, other third-parties, gambling results, other gaming devices, and awarding prizes. Examples of some of these routines and their operation are described below in conjunction with the flowchart depicted in FIG. 7.

The memory 312 may also store one or more databases, including a probability database 318, a payout database 320, a parameter value database 322, a game state database 324, a reel symbol database 326, an event probability database 328, and an event database 330. The program 316 may include instructions for retrieving, manipulating, and storing data in the databases as may be useful in performing various methods of the invention, as will be further described below. Examples of some or all of the data stored in each database 318, 320, 322, 324, 326, 328, 330 is described herein. The described entries of the databases 318, 320, 322, 324, 326, 328, 330 represent exemplary information only; those skilled in the art will understand that the number and content of the entries can be different from those illustrated herein. Further, despite any description of the databases 318, 320, 322, 324, 326, 328, 330 as tables, an object-based model could be used to store and manipulate the data types of the present invention and likewise, object methods or behaviors can be used to implement the processes of the present invention.

Note that, although these databases 318, 320, 322, 324, 326, 328, 330 may be described as being stored in a gaming device 104, in other embodiments of the present invention some or all of these databases 318, 320, 322, 324, 326, 328, 330 may be partially or wholly stored in another device, such as one or more of the peripheral devices 210, 212, 214, the peripheral device server 216 and/or the server controller 102, 202. Further, some or all of the data described as being stored in the databases 318, 320, 322, 324, 326, 328, 330 may be partially or wholly stored (in addition to or in lieu of being stored in the memory 312 of the gaming device 104) in a memory of one or more other devices, such as one or more of the peripheral devices 210, 212, 214, the peripheral device server 216 and or the server controller 102, 202.

As discussed herein, in at least one embodiment the gaming device 104 may be configured as a slot machine enabled to operate in conjunction with one or more processes the present invention. A more specific description of an exemplary slot machine suitable for use with at least one embodiment of the present invention follows. Of course, where appropriate, the slot machine may include fewer, different and/or additional components besides those discussed in this section. Also, it will be readily understood that some or all of the components and features described with respect to the exemplary slot machine may be used with one or more other types of gaming devices.

Generally, a slot machine comprises a three-reel or five-reel slot machine. The slot machine comprises a display area in which an outcome for a game of the slot machine is displayed to the player. The display area may, for example, be a video display that displays graphical representations of reels. In another example, the display area comprises glass, behind which mechanical reels are located. Within the display area, typically, is at least one payline. In some types of slot machine games, the player may choose to play using one or more available paylines. In accordance with one or more embodiments of the present invention, an outcome of a game comprises a set of symbols displayed along a payline of a reeled slot machine.

The slot machine may further comprise a handle. A player may initiate the movement of the reels in the display area by pulling on the handle. Alternatively, a player may initiate the movement of the reels in the display area by actuating a start button. Either or both of the handle and start button are exemplary embodiments of the input device 308, described herein. However it may be initiated, single play at a slot machine or other type of gaming device may be referred to herein as a "handle pull," whether or not a handle is involved in the play, and whether or not a handle is even included in the gaming device. In some embodiments a handle pull or single play may describe a single complete game and/or a single wager. For example, a handle pull might represent a single spin of the reels and/or a series of reel spins (e.g., which may culminate in a final aggregate outcome). In a video poker embodiment, a handle pull may be associated with the result of a first hand and a second hand, both in the same game.

Where appropriate, the slot machine may also include an alternate, secondary game screen, for outputting information to a player. The secondary game screen may be utilized, for example, to inform a player of game information, provide an offer, output a message, indicate that a game session has been initiated, indicate a game parameter value, indicate a collected game symbol, indicate the interaction of one game element or symbol with another game element or symbol, display a bonus game, indicate the terminating and/or initial value of a game parameter, indicate an offer to change a game parameter value, or indicate that a game session has been terminated.

The exemplary slot machine may also include a payment system comprised of a bill acceptor, a credit card reader, and a coin acceptor. A player may utilize the payment system to provide a wager for playing a game or game session. This payment system is an exemplary embodiment of the payment system 310, described herein.

The slot machine may further comprise a credit meter balance, which is an exemplary embodiment of a benefit output device 304 described herein. The credit meter balance reflects the amount of electronic credits currently available to a player. The electronic credits may be used by a player, for example, as wagers for games played on the gaming device. The electronic credits may also be "cashed out" as coins, bills, tokens, a cashless gaming receipt, and/or credits to another financial account associated with the player, as will be readily understood by those skilled in the art.

Finally, the slot machine may comprise a coin tray. As discussed herein, payment to the player may be rendered by dispensing coins into the coin tray. Such coins may be dispensed based on, for example, a player's indication that the player would like to cash out his credit meter balance and/or a payout obtained by a player as a result of playing a game on the slot machine. The coin tray is an exemplary embodiment of the benefit output device 304, described herein.

3. Databases

Although databases 318, 320, 322, 324, 326, 328, 330 are depicted as residing at the gaming device 104 in the example embodiment of FIG. 3, it will be understood that one or more of these databases could just as easily be implemented on one or more other devices.

Further, the individual database files could be stored on any number of different devices (e.g., located on different storage devices in different geographic locations, such as on a server 202 or a gaming device 104). For example, a gaming device may store a redundant copy of a controller's databases to protect against data loss or for any number of other reasons, and vice versa.

In embodiments in which, for example, the controller 102 serves/controls multiple casinos operated by different entities, a casino may wish to have a local copy of the portions of the databases that include entries related to that casino and may wish to exclude other casinos' access to that casino's information. Thus, some embodiments of a gaming device 104 may include local copies of some portions of one or more of the databases stored at a controller. Such a redundant configuration may provide enhanced system performance by reducing network communications. A distributed configuration may provide enhanced system security by allowing different casinos to store and maintain their own databases. A gaming device program (e.g., program 316) may include one or more routines to respond to requests from other gaming devices for player data, message data, game data, and game parameter data. In some embodiments, local versions of the databases are not stored on the gaming devices 104 at all and instead, the game device program accesses casino server databases which are stored and maintained exclusively on the controller 102. Likewise, in some embodiments, the databases may only exist on a third-party server and thus, both the controller 102 and the gaming devices 104 may access a third-party server for the data.

As will be understood by those skilled in the art, the schematic illustrations and accompanying descriptions of the sample databases presented herein are exemplary arrangements for stored representations of information. Other database arrangements may be used which would still be in keeping with the spirit and scope of the present invention. Any number of arrangements may be employed besides those suggested by the accompany figures. For example, even though a particular number of separate databases are illustrated, various embodiments of the invention could be practiced effectively using any number of functionally equivalent databases. In other words, the present invention could be implemented using any number of different database files or data structures, as opposed to the number depicted. Similarly, the illustrated entries of the databases represent exemplary information only; those skilled in the art will understand that the number and content of the entries can be different from those illustrated herein. Further, despite the depiction of the databases as tables, an object-based model could be used to store and manipulate the data types of the present invention and likewise, object methods or behaviors can be used to implement the processes of the present invention. These processes are described below in detail with respect to FIG. 7.

3.1. Probability Database

FIG. 4 depicts a tabular representation of an example of a probability database 318 according to some embodiments of the present invention. Where appropriate, a probability database 318 may be utilized in the performance of the inventive processes described herein. A probability database 318 may be stored in the memory 312 in tabular form, or any other appropriate database form, as is well known in the art. The data stored therein may include a number of exemplary records or entries, each defining a random number. Those skilled in the art will understand that the probability database 318 may include any number of entries. The tabular representation also defines, for each of the entries or records, fields that specify: (i) a random number 400 or range of random numbers that may be generated by the random number generator 302; and (ii) an outcome 402, that indicates the one or more indicia comprising the outcome that corresponds to the random number of a particular record.

A gaming device 104 may utilize a probability database 318 to determine, for example, what outcome corresponds to a random number generated by a random number generator 302 and to display the determined outcome. The outcomes may comprise, for example, the three symbols to be displayed along the payline of a three-reel slot machine. According to some embodiments of the present invention, an outcome may be used to determine whether a new stage of a game should be initiated.

3.2. Payout Database

FIG. 5 depicts a tabular representation of an example of a probability database 320 according to some embodiments of the present invention. Where appropriate, a payout database 320 may be utilized in the performance of the inventive processes described herein. A payout database 320 may be stored in the memory 312 in tabular form, or any other appropriate database form, as is well known in the art. The data stored therein includes a number of example records or entries, each defining an outcome that may be obtained on a gaming device 104 that corresponds to a payout. Those skilled in the art will understand that the payout database 320 may include any number of entries. The tabular representation also defines fields for each of the entries or records. The fields specify: (i) an outcome 500, which indicates the one or more indicia comprising a given outcome; and (ii) a payout 502 that corresponds to each respective outcome. The outcomes may be those obtained, for example, on a three reel slot machine.

A gaming device 104 may utilize the payout database 320 to determine whether a payout 502 should be output to a player as a result of an outcome 500 obtained for a game. For example, after determining the outcome 500 to output on the gaming device, the gaming device may access the payout database 320 to determine whether the outcome 500 for output is one of the outcomes stored as corresponding to a payout 502, e.g., "BAR, BAR, BAR" or "CHERRY, CHERRY, CHERRY" in FIG. 5. If it is, the gaming device 104 may provide the corresponding payout 502 to the player.

Of course, many other arrangements of the probability database 318 and the payout database 320 are possible. For example, *Winning at Slot Machines*, by Jim Regan (Carol Publishing Group Edition, 1997), illustrates examples of payout and probability tables and how they may be derived. The entirety of this book is incorporated by reference herein for all purposes.

3.3. Parameter Value Database

FIG. 6A depicts a tabular representation of an example of a parameter value database 322 according to some embodiments of the present invention. Where appropriate, a parameter value database 322 may be utilized in the performance of the inventive processes described herein. A parameter value database 322 may be stored in the memory 312 in tabular form, or any other appropriate database form, as is well known in the art. The data stored therein includes a number of example records or entries, each defining the current parameter value associated with a given parameter, as well as possible parameter values and/or the respective probabilities associated with the possible parameter values. Those skilled in the art will understand that the parameter value database 322 may include any number of entries. The tabular representation also defines fields for each of the entries or records. The fields specify: (i) a type of parameter 600; (ii) parameter values 602 that may be associated with the parameter; (iii) probabilities 604 associated with the possible parameter values; (iv) a current value 606 associated with the corresponding parameter; and (v) a terminating value 608 associated with the corresponding parameter.

According to some embodiments, parameter values 602 may correspond to possible initial values of the parameter 600. Such values may be used, for example, in determining the initial value of the parameter (e.g., based on the associated probabilities 604). For example, the parameter values 602 for the "carrot" parameter type 600 may be possible initial values for how many carrot symbols a player of the exemplary Garden Game (described further below) begins play with.

In other embodiments, parameter values 602 may correspond to possible terminating values of the parameter 600. Such values may be used, for example, in determining the terminating value(s) of the parameter (e.g., based on the associated probabilities 604). For example, the parameter values 602 for the "aces" parameter type 600 may be possible terminating values for a video poker session that ends once the player has been dealt a predetermined number of Aces (e.g., in one hand, or in total for a plurality of hands dealt).

FIG. 6B depicts a tabular representation of another example of a parameter value database 322 according to some embodiments of the present invention. Where appropriate, a parameter value database 322 may be utilized in the performance of the inventive processes described herein. The tabular representation also defines fields for each of the entries or records. The fields specify: (i) a type of parameter 650; and (ii) a current value 652 that is associated with the corresponding parameter. This simpler example of the parameter value database may be more appropriate for use with some embodiments of the present invention, such as those that do require storing sets of possible initial and/or terminating values.

A gaming device 104 may utilize the parameter value database 322, for example, to manage, track, and store parameter values during a gaming session. In accordance with some embodiments, a gaming device 104 may utilize the parameter value database 322 to determine whether to initiate and/or terminate a game stage or game session based on the terminating value 608 associated with a game parameter (and/or on a current value 606 of a game parameter). In accordance with some embodiments, a gaming device 104 may utilize the parameter value database 322 to determine the current state of a game (e.g., based on the current value 606 of a game parameter). In some embodiments, a payout or other game event may be based on the current value of a game parameter (e.g., in a race game, the player may receive a payout that is based on the final and/or average speed of his vehicle).

3.4. Game State Database

FIG. 7 depicts a tabular representation of an example of a game state database 324 according to some embodiments of the present invention. Where appropriate, a game state database 324 may be utilized in the performance of the inventive processes described herein. A game state database 324 may be stored in the memory 312 in tabular form, or any other appropriate database form, as is well known in the art. The data stored therein includes a number of example records or entries, each defining a particular state of an exemplary game. Those skilled in the art will understand that the game state database 324 may include any number of entries. The tabular representation also defines fields for each of the entries or records. The fields specify: (i) a state identifier 700 that uniquely identifies a state of a game; (ii) a state description 702 that includes a description of the state (e.g., the title of a stage or chapter of a game); and (iii) a reel set identifier 704 that indicates one or more reel sets associated with the particular game state.

The tabular representation depicts exemplary data indicating one way in which a game state may be linked to a reel symbol set. In one example entry, the state "S-3" is described as the "LOADING UP THE TREASURE" and is associated with a reel symbol set identified as "RS-03."

A gaming device 104 may utilize the game state database 324, for example, to manage, track, and store states during a gaming session. In accordance with some embodiments, a gaming device 104 may utilize the state database 324 in order to determine an appropriate set of reel symbols (or other type of game symbols or elements) to use in providing play during a particular state of the game.

3.5. Reel Symbol Database

FIG. 8 depicts a tabular representation of an example of a reel symbol database 326 according to some embodiments of the present invention. Where appropriate, a reel symbol database 326 may be utilized in the performance of the inventive processes described herein. A reel symbol database 326 may be stored in the memory 312 in tabular form, or any other appropriate database form, as is well known in the art. The data stored therein includes a number of example records or entries, each defining a set of symbols for use in an exemplary game. Those skilled in the art will understand that the reel symbol database 326 may include any number of entries. The tabular representation also defines fields for each of the entries or records. The fields specify: (i) a reel set identifier 800 that uniquely identifies a set of reels; (ii) symbols of the first reel 802; (iii) symbols of the second reel 804; and (iv) symbols of the third reel 806. Each of fields 802, 804, 806 includes an indication of the reel symbols for use on the corresponding reel. Although three reels are indicated, it will be understood that any number of reels may be used in accordance with the present invention.

In accordance with some embodiments, a gaming device 104 may utilize the reel symbol database 326 in order to determine an appropriate set of reel symbols (or other type of game symbols or elements) to use in providing play during a particular state of the game.

The reel symbol database 326 could of course have more or fewer fields, and could be unique for a particular gaming device. Although in this example a different reel symbol set identifier is depicted as being associated with each different state identifier, a particular set of reels may of course be associated with more than one state.

Although the symbol database 326 is described above as containing information about reel symbols, it will be readily apparent that a symbol database may be used to store information about various other additional or alternative types of game symbols, such as playing cards, puzzle pieces, etc., as deemed appropriate for a particular application.

Some of the sample data depicted in FIG. 8 is referred to below with respect to an exemplary Pirate Treasure game.

3.6. Event Probability Database

FIG. 9 depicts a tabular representation of an example of an event probability database 328 according to some embodiments of the present invention. Where appropriate, an event probability database 328 may be utilized in the performance of the inventive processes described herein. An event probability database 328 may be stored in the memory 312 in tabular form, or any other appropriate database form, as is well known in the art. The data stored therein includes a number of example records or entries, each defining one or more probabilities of a game event occurring (e.g., based on the stage of a game). Those skilled in the art will understand that the event probability database 328 may include any number of entries. The tabular representation also defines fields for each of the entries or records. The fields specify: (i) an event identifier 900 that uniquely identifies a game event; (ii) an event type 902 that includes an indication or description of the event; (iii) a probability 904 that indicates a probability of the event occurring a first stage of a game; and (iv) a probability 906 that indicates a probability of the event occurring a second stage of a game. Although probabilities for two stages are indicated, it will be understood that the probabilities corresponding to any number of stages may be stored in the event probability database 328, and that not all of the stages of a particular game need be represented in the event probability database 328.

In accordance with some embodiments, a gaming device 104 may utilize the event probability database 328 in order to determine whether an event occurs in a game (e.g., based on the particular stage or state of the game). In one example, the entry "EVENT-64" indicates that a "RAIN SHOWER" event is more like to occur in one stage of a game ("10%" probability) than in another stage of the game ("5%" probability). This information may be for use, for example, in a race game in which the first half of the race is presented as having worse weather than the second half (e.g., a weather event may affect the speed of a racer and/or a payout amount to the player). A probability may be represented in a variety of well known ways, such as a percentage, a ratio, or a number between zero and one, inclusive.

3.7. Event Database

FIG. 10 depicts a tabular representation of an example of an event database 330 according to some embodiments of the present invention. Where appropriate, an event database 330 may be utilized in the performance of the inventive processes described herein. An event database 330 may be stored in the memory 312 in tabular form, or any other appropriate database form, as is well known in the art. The data stored therein includes a number of example records or entries, each defining a game event that is associated with one or more game symbols. Those skilled in the art will understand that the event database 330 may include any number of entries. The tabular representation also defines fields for each of the entries or records. The fields specify: (i) an event identifier 1000 that uniquely identifies a game event; (ii) a first symbol 1002 that includes an indication or description of a first game symbol; (iii) a first symbol identifier 1004 that includes an identifier that uniquely identifies the first game symbol; (iv) a second symbol 1006 that includes an indication or description of a second game symbol; (v) a second symbol identifier 1008 that includes an identifier that uniquely identifies the second game symbol; and (vi) an event description 1010 that includes a description of the event and/or an indication of how the event may be represented (e.g., to a player).

In some embodiments, each of the first symbol 1002 and the second symbol 1006 may correspond to a different stage of a game. For example, the exemplary event "EVENT-02" involves a "TREASURE CHEST" symbol that appears only in a first stage of a game, and a "KEY" symbol that appears only in a second stage of a game. If both symbols have appeared, the exemplary data indicates that the chest symbol is to be "opened" (e.g., by representing on a secondary game screen the chest being opened with the key) and a random treasure value is to be determined (which may or may not be displayed to the player).

Thus, in some embodiments of the present invention, one symbol may interact with another symbol, as in the example of the chest and key discussed above. In other embodiments, one symbol may perform some other type of operation on another symbol or game element, such as a "rabbit" symbol stealing a "carrot" symbol a player had collected previously.

In another example, a "storm" game element may operate on a displayed "ship" game element to divert the ship from its intended destination.

In some embodiments, an event may include or be associated with a payout. In some embodiments, an event may include or trigger the determining or adjusting of a value of a game parameter (e.g., a running tally of fruit symbols or treasure that a player has remaining).

4. Processes

The exemplary system discussed above, including the hardware components, software components, and the databases, are useful to perform various methods of the invention. However, it should be understood that not all of the above-described components and databases are necessary to perform any of the methods of the present invention. In fact, in some embodiments, none of the above-described system is required to practice the methods of the present invention. The system described above is merely an example of a system that would be useful in practicing some methods of the invention.

Figure 11:
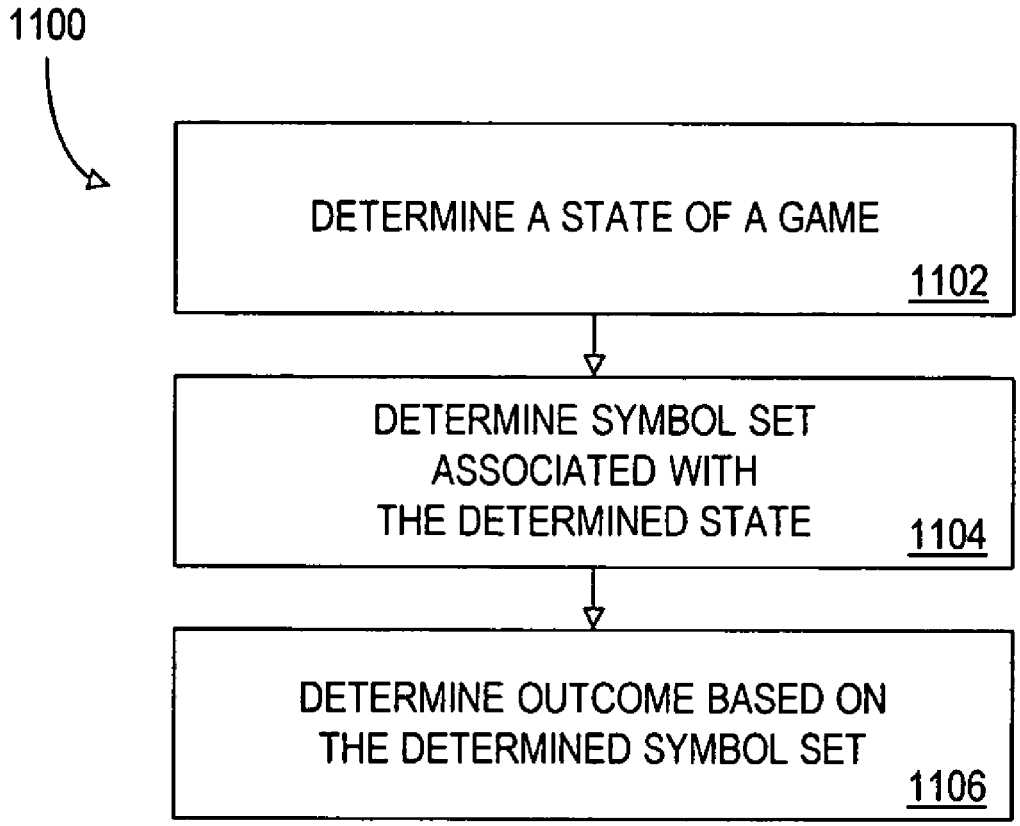
FIG. 11 is a flow chart illustrating an example process according to some embodiments of the present invention.

Referring to FIG. 11, a flow chart 1100 is depicted that represents some embodiments of the present invention. Although the method 1100 is discussed as being performed by a slot machine, it will be understood in light of the present disclosure that the method may be performed by a controller 102, a gaming device 104, a peripheral device 210, a peripheral device server 216, and/or a casino. It must be understood that the particular arrangement of elements in the flow chart 1100 of FIG. 11, as well as the number and order of example steps of other various methods discussed herein, is not meant to imply a fixed order, sequence, quantity, and/or timing to the steps. Embodiments of the present invention can be practiced in any order, sequence, and/or timing that is practicable. Likewise, the labels used to reference the individual steps of the methods are not meant to imply a fixed order, sequence, quantity, and/or timing to the steps.

In general terms and still referring to FIG. 11, method steps of some embodiments of the present invention may be summarized as follows. In step 1102, a state of a game is determined. In step 1104, one or more symbols associated with the state of the game are determined. In step 1106, an outcome is determined based on the determined symbols. As indicated above, in some embodiments these steps may be performed in a different order, and more, fewer, and/or alternative steps may be used as well.

In the discussion that follows, each of these exemplary steps will be discussed in greater detail. Note that not all of these steps are required to perform the methods of the present invention and that additional and/or alternative steps are also discussed below. Also note that the above general steps represent features of only some of the embodiments of the present invention. Such steps may be combined and/or subdivided in any number of different ways so that methods of the present invention include more or fewer actual steps. For example, in some embodiments additional steps may be added to update and maintain the databases described above. As indicated, however, it is not necessary to use the above-described databases in all embodiments of the invention. In some embodiments, a described step may be performed by or with respect to any number of devices or entities. For example, a step may be subdivided into sub-steps, some of which are performed by one device, and some of which are performed by or otherwise involve a different device. In other words, the methods of the present invention may contain any number of steps performed by any number of entities that are practicable to implement the various different inventive processes described herein.

The following example "Pirate Treasure" game will be used to illustrate some embodiments of some of the steps of exemplary process 1100. The example should not be construed as limiting the scope of the invention in any way. Various other embodiments and examples of embodiments are discussed in further detail herein, and others will be apparent to those skilled in the art in light of the present disclosure. It will also be understood that many other types of games and gaming devices consistent with at least one embodiment of the present invention may incorporate exemplary features and game play (or variations thereof) described in the Pirate Treasure game example.

Pirate Treasure may be played on a three-reel slot machine. A player pays twenty credits for a single game which lasts for twenty-five handle pulls. During the game, the player tries to discover treasure and then safely bring the treasure home. There are five stages to the game, which may be described as follows:

1. Discovering treasure
2. Opening the chests
3. Loading up the treasure
4. Transporting the treasure
5. Unloading the treasure In accordance with one embodiment of the game, each of the five stages lasts for five reel spins (providing for twenty-five spins in total). During the first stage ("Discovering treasure"), the player's objective is to collect as many treasure chests as he can in five spins. The player collects a chest when a "chest" symbol appears on a payline as a result of a handle pull (i.e., when the symbol is included in a reel outcome). Each time a chest symbol appears on the payline, a representation of a chest is displayed on a secondary screen of the gaming device (e.g., the chest is depicted as appearing on a beach).

Each of the chests is associated with a particular credit value. The value may be predefined for particular chest symbol that appeared, or the value may be determined at random. In one example, each chest is associated with treasure having a value of between five and one hundred coins. In one variation of the game, the value of the treasure in the chest is displayed to the player when he receives the chest. In another variation, the value is not indicated to the player until later, or not at all (e.g., if the player loses the chest). The slot machine may store an indication of the value of each collected chest and/or a total value of collected chests, for example, in a database record corresponding to an appropriate game parameter.

In the Pirate Game, the accumulation of chests in the first stage does not mean that the player necessarily receives (e.g., as a payout) the value associated with those game elements. After the first stage terminates (e.g., after the fifth spin), the game initiates the second stage ("Opening the chests"). During the second stage, the objective is to "open" the chests (e.g., to gain access to any stored treasure). During this stage the player is trying to get "crowbar" and "key" symbols on the payline. The slot machine keeps track of the crowbar and key symbols received by maintaining a running count in memory. At the end of the second stage, an animated graphic on the secondary screen displays the keys and crowbars being used in an attempt to open all of the collected chests. In one variation of the game, some chests may open with a key, some may require a crowbar, some may require both, and some may not open at all. In some variations, the value of a chest may be determined after it is opened (i.e., after the symbol from the first stage and the symbol appearing in the second stage interact). If any chests are opened, the player can "remove" the treasure. For example, the player may have been able to open (e.g., using keys and crowbars) three of five collected chests. The total value of the treasure in the opened chests is two hundred fifteen coins, and this value is stored by the slot machine. In some variations, the treasure value is displayed on the secondary game screen or otherwise communicated to the player.

The game proceeds to a third stage ("Loading up the treasure") in which the player attempts to get the treasure onto his ship. In this stage, the player tries to get rowboat and rope symbols on the payline. The more such symbols he receives, the more treasure he will be able to load onto his ship. For example, if the player receives three rope symbols and one rowboat symbol, he might be able to transport 80% of the treasure from the beach to his ship. The slot machine continues to monitor and adjust the value of the treasure the player has been able to retain based on the events of the game.

In stage four ("Transporting the treasure") the goal is to sail the ship back to a safe harbor. The reel symbols used in the fourth stage include "wind" symbols, which help advance the player toward the harbor, and "storm" symbols that can knock the player off course. The ship's progress toward the harbor is represented on the secondary game screen, and the events of wind and storm may be represented by animation as interacting with a displayed ship. In some variations, a storm or "pirate" symbol may cause the loss of some of the treasure being transported. Thus, the player may reach the harbor with less treasure than he started the stage. In some embodiments, the player may be able to pirate another ship, and thus increase his accumulated treasure.

In the final stage ("Unloading the treasure") the player tries to get rope and barrel symbols on the payline in order to bring the treasure safely to shore. At the end of the final stage (e.g., at the conclusion of the twenty-five spins), the player is awarded a payout based on the amount of treasure that he has brought home safely. The payout amount may be the indicated value of the treasure, or may be any other amount. For example, different payout amounts may correspond to different ranges of treasure value returned to harbor (e.g., twenty coins for one hundred to two hundred treasure points, fifty coins for three hundred to one thousand treasure points, etc.).

In some variations of the Pirate Game, the player can win a payout (e.g., a jackpot) on any of the spins during the game (e.g., by matching three symbols), but most of the payout in the game is expected to come during the final stage when the player is able to cash in the treasure he has managed to retain.

Referring again to FIG. 11, in step 1102 a state of a game is determined. In some embodiments, a slot machine determines its current state. The state of the slot machine may be, for example, a reflection of one or more current conditions of the game (or of the gaming device), and/or may be based on various other information, as described further below.

In some embodiments, the state of a game may correspond to a particular stage of the game. For example, a slot machine might be in one of two states: a basic game and a bonus round. Some more complicated games may have many possible states. Some examples of states of a game (or of a gaming device) include, without limitation:

(i) Basic game and bonus round (e.g., conventional reel spinning game, and a bonus game that may provide payouts without the player having to make any additional wagers)

(ii) Initial parameter setting state and game play state (e.g., setting up the initial number of carrots that a player starts with in an exemplary "Garden Game," and then a game play stage which adds and/or subtracts from the number of carrots)

(iii) Collection state and cashing-in state (e.g., player spends ten spins collecting treasure symbols, and then ten spins trying to "cash in" the collected symbols by opening up those treasures to win coins)

(iv) Regular state and multiplier state (e.g., player gets normal payouts during the regular state, and doubled or tripled payouts in the multiplier state)

(v) Low probability state and high probability state (e.g., player has a one in a million chance at getting the jackpot payout during the low probability state, and a one in ten thousand chance during a high probability state)

(vi) Basic game and free spins (e.g., conventional reel spinning game and a period during which free spins are offered)

For instance, in the exemplary Pirate Treasure game, after every five spins the game progresses to the next state. The state of the game may thus be determined in a relatively straightforward manner by, for example, determining the number of spins already taken (e.g., as stored in a parameter value database). There are, however, many additional or alternative ways to trigger a change from one state of a game to the next, including, without limitation:

(i) Appearance of a particular symbol or outcome on a payline (ii) Elapsed time (e.g., each state is in effect for 60 seconds)

(iii) Player input (e.g., player hits a "change stage" button)

(iv) Completion of a first stage (e.g., the player collects 10 carrot symbols)

(v) When the player hits a payout of X coins (vi) When the player inserts a bill into the bill validator (vii) A game randomly changes to a different state According to some embodiments of the present invention, determining a state of a game or gaming device may include one or more of: (i) determining whether a stage has been or should be initiated, (ii) determining whether a stage has been or should be terminated (e.g., based on a terminating condition), and (iii) determining a value (e.g., a current value, a terminating value, an initial value) that is associated with a game parameter.

As discussed herein, the value of some types of game parameters may be tracked and adjusted during two or more stages or states of a game. In some embodiments, a game parameter value (e.g., of a secondary game) may be affected by two independently-generated game events (e.g., a reel outcome and another type of random game event).

In step 1104, one or more symbols associated with the state of the game are determined. According to some embodiments, the slot machine then determines what reel symbols are associated with the determined state of the game. For example, as discussed herein, a state may be associated with a particular set of symbols as indicated in a record of the game state database 324.

Accordingly, once the current state is identified, an associated set of game symbols may be determined. For instance, the particular symbols associated with the current state may be stored and/or retrieved from the reel symbol database 326. In the example of the reel symbol database 326 depicted in FIG. 8, the exact number and type of each reel symbol is stored in a field of a record.

Referring again to the Pirate Treasure game example, the slot machine could populate the graphical reels based on the appropriate set of reel symbols identified in the game state database 324. For example, when the game is in the third stage ("Loading up the treasure"), the second reel of the machine would show two boats, two ropes, five pulleys, on crate, five workers, and seven blanks from symbol set "RS-03." For the five spins of this third stage, this symbol set would be used to determine the universe of possible reel symbols attainable on the second reel. The probability of any of these reel symbols appearing on the payline could be directly proportional to the number of symbols of that type represented on the reel, or the probability could be non-uniform, as will be understood by those of ordinary skill in the art.

Note that in the example of the Pirate Treasure game, there are unique symbol sets associated with each stage of the game. To make it clear to players that the symbols were changing during stage changes, a gaming device could provide informational messages to the player indicating why the process was occurring. For example, the player might see an introductory screen which said "You accumulated a lot of treasure in the first stage of the game, let's bring in a new set of symbols for the second stage. Try to get as many crowbar and keys symbols on the payline as you can—they open the chests. Good luck!"

Replacing the symbols of one stage with symbols for a following stage could be accomplished in a variety of ways, and may be done in a manner that entertains the player, in addition to carrying out the function of changing the reels.

In one example, the symbols from one stage might be "shot off" the reels with a cannon. Then a treasure chest is opened to reveal the new symbols for the next stage, and the new symbols are dropped onto the now blank reels. Other exemplary methods of presenting or generating the effect of clearing the reels include, without limitation:

(i) Digitally removing the game symbols (i.e. eliminating one or more reel stop positions from the electronic reels or turning one or more reel stop positions into blank symbols)

(ii) Graying out game symbols (iii) Making the symbols smaller (e.g., minimizing or reducing)

(iv) Animating the reels to make it look like they are spinning, and then having a virtual blade appear to "scrape off" the symbols (v) Animating the reels to make it appear that they are being dipped in an acid solution which washes away the reel symbols (vi) Animating the reels to make it appear that they are being washed away by waves Once the reels have been cleared of the game symbols associated with the previous stage, the symbols representing the next stage may be applied. As in the case of removing symbols, the applying process could be done a variety of ways, and may be designed to be entertaining. Some examples include, without limitation: (i) "dropping" the new symbols from a secondary screen onto the reels; and (ii) "dipping" the cleaned reels into a bucket containing the new symbols, with some of all of the symbols sticking to the reels.

Instead of changing the reel symbols on the reels (e.g., as if the reels themselves were constant), the gaming device could "swap out" the first stage reel symbol set and replace it with a symbol set associated with the next stage. The swapping out process could be graphically represented, for example, in a way that made it clear that one set of reels was replacing another. In one example, an animation reveals one set of reels being pushed back into the machine or off to the side, while the second set of reels appears from the front of the machine to replace it. Other ways of representing the swapping out of reels may be readily apparent to those having ordinary skill in light of the present disclosure.

Although reel symbol sets have been discussed above, other types of game elements may be associated with different states of a game or gaming device. For example, as discussed further below, different stages of a poker game may use different decks of cards. Game elements may include, for example, game symbols (e.g., a reel symbol), game characters, and/or game events (e.g., a random weather event that affects a race game). In some embodiments, as discussed herein, one or more game elements may affect a game parameter value. In some additional embodiments, one or more game elements may interact or otherwise have a relationship that may affect an outcome and/or payout.

In step 1106, an outcome is determined based on the determined symbols. In some embodiments, the slot machine determines an outcome based on the determined symbol set. For example, a random number is generated by the random number generator of the slot machine, and this random number is then associated with an outcome including at least one of the determined reel symbols. Those of ordinary skill in the art will appreciate that there are many methods by which to determine a random number, such as algorithms stored in electronic memory or physical random number generators (such as a lottery blower type device). For example, in the Pirate Treasure game the random number 03459 might correspond to the result of "boat-pulley-crate." Note that while this particular outcome may not necessarily lead to a direct coin payout for the player, it may have an indirect effect on the number of coins won by the player. For instance, the boat symbol may help the player successfully load up more of his treasure, which may result in a greater payout to the player at the end of the game. In another example, "pulley-pulley-pulley" outcome may both help the player load treasure and provide a payout of its own (e.g., according to a standard payout table).

Of course, other slot machine games having different states may determine outcomes that directly result in the player winning coins, earning free spins, winning merchandise, and/or other types of benefits.

According to various embodiments of the present invention, the above-described process may performed by a gaming device and/or a server periodically (e.g., after a predetermined period of time), according to a schedule, at the occurrence of a predetermined event or condition (e.g., at the end of a game stage), or substantially continuously (e.g., by a monitoring program or entity).

As discussed herein with respect to the exemplary Pirate Treasure game, the value associated with a determined game element or reel symbol, such as the exemplary treasure chest symbol, may not necessarily be paid out to a player. In some games, for example, a determined value may be at risk of being reduced or eliminated completely, for example, based on subsequent outcomes and/or other types of game events (e.g., in a different stage of the game). Thus, according to some embodiments, the determined value may represent a maximum potential payout amount. The value may be tracked over time and/or over multiple handle pulls, as discussed herein, and a payout may be provided based on the value (e.g., a running count) at the termination of a stage or game session.

In addition to, or in lieu of being associated with a particular set of reels, each state of a game or gaming device could be associated with a particular set of probabilities. Thus, while one or more reel symbols may stay the same (e.g., from stage to stage), the probability that any particular reel symbol appears on the payline may change from stage to stage. In some embodiments, the probability of a particular game event occurring may change from stage to stage. Such embodiments may be particularly appropriate for games in which activities are occurring on a secondary screen (e.g., as in the exemplary "Speedway" race game described herein).

In one example, a gaming device may be in a "hot" stage, in which the probability of a particular game event is more likely than during a "cold" stage.

Figure 12:
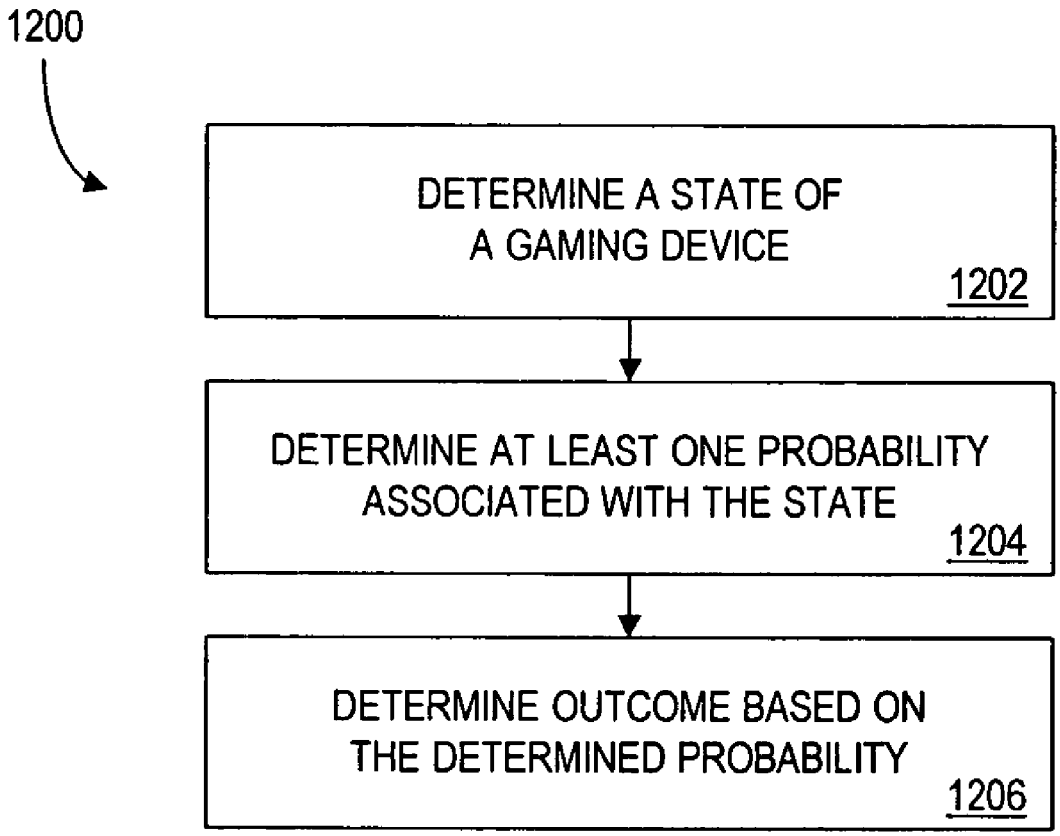
FIG. 12 is a flow chart illustrating an example process according to some embodiments of the present invention.

Referring to FIG. 12, a flow chart 1200 is depicted that represents some embodiments of the present invention. Although the method 1200 is discussed as being performed by a slot machine, it will be understood in light of the present disclosure that the method may be performed by a controller 102, a gaming device 104, a peripheral device 210, a peripheral device server 216, and/or a casino.

In general terms and still referring to FIG. 12, method steps of some embodiments of the present invention may be summarized as follows. In step 1202, a state of a gaming device is determined. In step 1204, one or more probabilities associated with the state of the gaming device are determined. In step 1206, an outcome is determined based on the determined probabilities. As indicated above, in some embodiments these steps may be performed in a different order, and more, fewer, and/or alternative steps may be used as well.

In step 1202, a state of a gaming device is determined. Determining the state of a gaming device may comprise, without limitation, determining a state (or stage) of a game (e.g., whether the game is in a bonus round, the amount of a progressive jackpot), determining information about the gaming device (e.g., amount of coin in, amount paid out, period of time since a jackpot was achieved), determining information about a player (e.g., net win/loss, demographic information, period of time at the gaming device, a number of associated comp points, a period of time since receiving a winning outcome), determining information from a hotel reservation system (e.g., a number of rooms available), determining inventory information (e.g., a number of a product in stock), or any combination thereof. Various types of information that may be used in determining the state of a gaming device are discussed herein; other types may be readily understood by those of ordinary skill in the art in light of the present disclosure.

The state of the gaming device could be based at least in part on game play at the gaming device, or could be independent of game play. In step 1204, one or more probabilities associated with the state of the gaming device are determined. For example, in an exemplary race game, after determining that the game is in a first stage, the slot machine may refer to the event probability database 328 to determine the likelihood that the "DOWN HILL" event will occur during that stage (e.g., causing the player's vehicle to speed up). According to the sample data, there is a "50%" chance of the event happening during the first stage.

According to another example, the slot machine may determine the probability of a collected game symbol expiring, being stolen, or otherwise being removed from play.

In some embodiments, the probability of an event occurring in one stage is greater than zero, while the probability of the event occurring in another stage is zero (i.e., the event cannot happen). In other embodiments, the event may occur in two or more stages (e.g., the probability is greater than zero for each stage).

Some types of events may be related to play of a basic game, such as a handle pull in a reel-based slot machine game. The occurrence of other types of events may be independent of handle pulls or other types of random events that may be initiated by or generated in response to a signal from a player.

In step 1206, an outcome is determined based on the determined probabilities. Referring again to the race game example, the slot machine may determine whether the race has been affected by the "DOWN HILL" event. For instance, the slot machine may determine that the "DOWN HILL" event has occurred, and may increase the indicated speed of the player's vehicle (or adjust one or more other game parameter values). In another example, the slot machine may determine that bad weather has affected the transport of treasure in the Pirate Treasure game, based on a likelihood of such an event occurring in that particular stage of the game.

Some embodiments of the present invention allow for a set of cards to be determined for a card game based on the stage of the game. In general terms, method steps of some embodiments of the present invention may be summarized as follows. In one step, a state of a card game is determined. In another step, a set of cards associated with the state of the game is determined. In another step, an outcome is determined based on the determined set of cards. For illustrative purposes only, the above general steps will be discussed further below with respect to a video poker game played at a video poker machine.

In one step, a state of the card game is determined. In a video poker embodiment, different states of the game could be associated with decks of cards having different card compositions. For example, a five-state video poker game might use the following five decks of cards:

1. Standard 52 card deck
2. 52 card deck with a joker
3. 52 card deck with deuces wild
4. 52 card deck with all tens and nines removed
5. 52 card deck with an extra set of 13 spade cards Once the state is determined, as discussed variously herein, a set of cards associated with the stage of the game is determined (e.g., by reference to a database of corresponding card sets). An outcome may then be determined based on the determined set of cards. For example, the video poker machine may deal one or more hands to the player using the determined set of cards. Various ways of dealing cards to players as appropriate for different games will be readily apparent to those skilled in the art in light of the present disclosure.

One or more embodiments of the present invention provide for determining a first symbol from a first reel outcome, determining a second symbol from a second reel outcome, and determining a game event based on the first symbol and the second symbol. For example, as discussed herein, a player in the Pirate Treasure game may receive a chest symbol in a first stage and a key symbol in a second game stage. The symbols may be related, for example, in an event database 330. Based on the occurrence of the two symbols, a particular game event may be triggered. For example, a key symbol may open a collected chest in the Pirate Treasure game. In some embodiments, a game parameter value may be adjusted based on the determined game event. For example, if a game event corresponds to a revealed treasure value of fifty coins in the Pirate Treasure game, the parameter used to keep a running count of how much treasure the player currently has may be updated based on the value of the treasure.

As discussed herein, one or more embodiments of the present invention may use running counts or other types of parameter values that may span time and/or multiple handle pulls. Methods and apparatus that, among other things, permit and enable various ways of determining and tracking running counts related to games and game events, and are appropriate for use in accordance with the present invention, are disclosed in U.S. patent application Ser. No. 10/778,576, filed Feb. 13, 2004, entitled "METHOD AND APPARATUS FOR ENHANCED PLAY OF A GAMING DEVICE," the entirety of which is incorporated herein by reference.

As discussed herein, one or more embodiments of the present invention may rely on various game parameters. Methods and apparatus which, among other things, permit and enable various ways of determining game parameters, determining possible (initial and/or terminating) values of game parameters, and setting values for game parameters, and are appropriate for use in accordance with the present invention, are disclosed in U.S. patent application Ser. No. 10/784,845, filed Feb. 23, 2004, entitled "METHOD AND APPARATUS FOR SETTING GAME PARAMETERS" and in U.S. patent application Ser. No. 10/792,014, filed Mar. 3, 2004, entitled "METHOD AND APPARATUS FOR BOUNDING PLAY OF A GAMING DEVICE." For example, these applications discuss various ways of setting an (initial or terminating) value of a parameter (e.g., what parameter value play will begin or end with), such as by using a slot machine reel spin to determine a parameter value at random.

One or more embodiments of the present invention may be advantageously applied to games and gaming devices available for prepaid sessions of play. The cost of some types of prepaid sessions may be predetermined. For instance, any play of the exemplary Pirate Treasure game might cost twenty credits. Some types of prepaid sessions may allow for a player to select parameters that define the session (e.g., number of handle pulls, number of a particular reel symbol), and the price for the session may be determined based on such parameters. Methods and apparatus that, among other things, permit and enable various ways of determining the price of a game session, and are appropriate for use in accordance with the present invention, are disclosed in U.S. patent application Ser. No. 10/001,089, filed Nov. 2, 2001, entitled "GAMING DEVICE FOR A FLAT RATE PLAY SESSION AND METHOD OF OPERATING SAME," which is incorporated by reference herein.

The following examples illustrate some embodiments and features of the present invention. The following examples are provided merely to illustrate some embodiments of the present invention, and should not be construed as limiting the scope of the invention in any way. Various other embodiments and examples of embodiments are discussed in further detail herein, and others will be apparent to those skilled in the art in light of the present disclosure.

According to one example of a game provided in accordance with at least one embodiment of the present invention, a player inserts a bill into a bill validator of a "Garden Game" slot machine and establishes a balance of eighty credits. The game allocates the player a number of carrots, which populate a virtual garden on a secondary screen. Every time a rabbit symbol appears on the payline of one of the reels, one or more of these carrots are stolen by a rabbit game character (e.g., as animated on the secondary screen). The game costs twenty credits, and the player is able to continue making reel spins until all of his carrots are stolen. After receiving twenty credits to start the session, the slot machine enters a first stage of the Garden Game, in which the initial number of carrots the player will start with is determined. All of the reel stop positions are populated with carrot symbols numbered "1," "2," "3," and "4." The player spins the reels, which stop and show a result of "2-4-3," for a total of nine carrots. The slot machine then electronically populates the virtual garden on the secondary screen with nine carrots. The game then moves into a second stage, in which the player is able to spin the reels repeatedly until all of his carrots are lost to the rabbit. For the second stage, the carrot reel symbols used in the first stage are replaced with other reel symbols, including the rabbit symbols mentioned above, and the player can receive payouts for various winning reel outcomes (e.g., two or more matching reel symbols appearing on the payline).

According to another example of a game provided in accordance with some embodiments of the present invention, a player chooses to play a "Speedway Game" with a car race theme. The game costs twenty credits for each activated payline. The player chooses to activate just one payline. The game is played by generating reel spins (e.g., using the slot machine handle). The reel symbols include numbers that correspond to the speed (e.g., in miles per hour) of an animated racecar depicted on a virtual racetrack on a secondary game screen of the slot machine. The current car speed is displayed on the secondary game screen. Every reel spin results in an increase to the speed of the player's car. A reel result of "+6, +10, +2", for example, would increase the speed of the car by 18 miles per hour (6+10+2=18). Although the car gains speed based on the outcomes of the reel spins, the car may be slowed down periodically by events occurring on the virtual race track (as shown on the secondary game screen). Depicted events such as oil slicks on the road, mechanical failures, and bad weather, may slow down the player's car. During the game, the player's car races around the virtual track, and eventually crosses a finish line. After the car crosses the finish line, the player is awarded a payout. The faster the car was going when it crossed the finish line, the larger the coin payout to the player. Additional bonuses are available for achieving high average rates of speed during the lap.

Play of the Speedway Game is divided into two stages. For example, the race may include a daytime driving portion and a nighttime driving portion, a first portion of the track and a second portion of the track, two different race tracks, or use of two different vehicles. The respective probabilities of some (or all) of the speed-reducing events differ from stage to stage. For example, during the first stage the probability of oil slicks and mechanical failures is very low, but are much more likely during the second stage. In another example, bad weather is very likely during the first stage, but rarely occurs during the second stage. The probability of an event occurring in a particular stage is stored in a probability database. For example, the database may include two sets of event probabilities, one for each half of the race.

Continuing with the Speedway Game example, the player completes a lap of the virtual racetrack and crosses the finish line at 156 miles per hour, with an average speed for the lap of 121 miles per hour. The player's car was slowed down twice by mechanical failures (a 32 mile per hour drop and a 45 mile per hour drop) and once by a rain storm (a 23 mile per hour drop). Based on the final speed and the average speed of the player's racecar, the gaming device pays the player twenty-four coins.

5. Additional Embodiments

Rather than determining what state the gaming device is in via a database lookup or formula, the state could be determined randomly. For example, a spinner displayed on a secondary screen could spin to one of three states. The state that it lands on then becomes the state for a period of time (e.g., twenty minutes) or a number of game plays (e.g., the next 25 spins). Alternatively, the state could stay fixed until the player got a "change state" symbol on one of the paylines, in which case the spinner could be triggered to determine another state.

The process of changing the state of a gaming device could be triggered by one or more actions of the player. Such actions might include, without limitation:

(i) Player loses more than X spins in a row
(ii) Player gets X "close calls" in a row (e.g., two of the reel symbols match)
(iii) Player loses more than $X in Y minutes/handle pulls
(iv) Player deposits more than $X into the machine
(v) Player speeds up play
(vi) Player slows down play According to some alternative embodiments of the present invention, instead of having one set of reel symbols replace another set of reel symbols as a result of a state change, multiple sets of reel symbols could be displayed on the reels of the game. For example, in the Pirate Treasure game each reel could have 110 reel stops containing all of the reel symbols indicated in the reel symbol database. In this embodiment, the processor of the gaming device "activates" one set of reels for each game state. During the third game state, the reel symbols associated with the other stages appear on the reels but have a zero probability of landing on the payline. Alternatively, all of the non-active symbols could be grayed out or made to appear much smaller so as to indicate to the player that they are not active for that particular stage. The five sets of reels stops that comprise each 110 stop reels could be grouped into five sets of 22 reel stops, for example, or could be intermixed among each other.

While the method and apparatus of the present invention have been described in terms of its presently preferred and alternate embodiments, those skilled in the art will recognize that the present invention may be practiced with modification and alteration. The specifications and drawings are, accordingly, to be regarded in an illustrative rather than a restrictive sense. Further, even though only certain embodiments have been described in detail, those having ordinary skill in the art will certainly appreciate and understand that many modifications, changes, and enhancements are possible within the scope of the accompanying claims. All such modifications are intended to be encompassed within the following claims.

What is claimed is:

1. A method of operating a gaming system, said method comprising, for each play of a game:

(a) causing a gaming device to determine a first reel outcome of said play of the game from a first set of reel symbols;
(b) causing the gaming device to determine a first amount for said play of the game, the first amount based on the first reel outcome;
(c) causing the gaming device to determine a second reel outcome of said play of the game from a second set of reel symbols; and
(d) causing the gaming device to determine a payout amount to be provided for said play of the game, the payout amount based on the first amount and the second reel outcome, the payout amount being equal to or less than the first amount;

wherein for said play of the game, a first probability of a first symbol being included in the first outcome is different than a second probability of the first symbol being included in the second outcome, and the first probability and the second probability are each greater than zero for each determination of said first reel outcome and said second reel outcome.

2. The method of claim 1, which includes, for each play of the game, causing the gaming device to determine the first reel outcome during a first stage of each play of the game and causing the gaming device to determine the second reel outcome during a second stage of each play of the game.

3. The method of claim 1, which includes, for each play of the game, causing the gaming device to determine the first reel outcome based on a first set of reel symbols and causing the gaming device to determine the second reel outcome based on a second set of reel symbols, wherein the first set of reel symbols includes at least one second symbol not included in the second set of reel symbols, and wherein the second set of reel symbols includes at least one third symbol not included in the first set of reel symbols.

4. The method of claim 3, further comprising, for each play of the game, causing the gaming device to determine a penalty amount based on the second reel outcome if the second reel outcome includes the at least one third reel-symbol.

5. The method of claim 4, which includes, for each play of the game, causing the gaming device to determine the payout amount based on the first amount and the penalty amount.

6. The method of claim 4, which includes, for each play of the game, causing the gaming device to determine the payout amount by subtracting the penalty amount from the first amount.

7. The method of claim 1, further comprising, for each play of the game, causing the gaming device to determine a percentage value based on the second reel outcome.

8. The method of claim 7, which includes, for each play of the game, causing the gaming device to determine the payout amount based on the first amount and the percentage value.

9. The method of claim 1, wherein for at least one play of the game, payout amount is less than the first amount.

10. The method of claim 1, wherein for at least one play of the game, payout amount is equal to the first amount.

11. The method of claim 1, wherein for at least one play of the game, the payout amount is zero.

12. The method of claim 1, further comprising, for each play of the game, causing a display device to display an indication of the first amount.

13. The method of claim 1, further comprising, for each play of the game, providing any payout amount to a player.

14. The method of claim 1, further comprising causing the gaming device to initiate a prepaid session of the at least one play of the game.

15. The method of claim 1, further comprising causing the gaming device to initiate a flat rate play session of the at least one play of the game.

16. The method of claim 1, wherein for each play of the game, the first set of symbols is associated with a first stage, the second set of symbols is associated with a second stage, and which includes, for at least one play of the game:

(e) causing the gaming device to display a fourth symbol of the first reel outcome as a first physical item;
(f) causing the gaming device to display a fifth symbol of the second reel outcome as a second physical item; and
(g) causing the gaming device to display a representation of the second physical item performing an action on the first physical item.

17. A method of operating a gaming system, said method comprising:

causing at least one processor of at least one gaming device to operate with at least one memory device, at least one display device, and at least one input device to:

(a) initiate a game session that includes a basic game and a secondary game;
(b) determine a first reel outcome in a first stage of the basic game, the first reel outcome associated with a first non-zero probability of including a first symbol, the first symbol associated with a first value;
(c) determine if the determined first reel outcome includes the first symbol, and if the determination is that the determined first reel outcome includes the first symbol, alter a game parameter value of the secondary game based on the first value, the game parameter value associated with a possible award amount;

(d) determine a second reel outcome in a second stage of the basic game, the second reel outcome associated with a second non-zero probability of including a second symbol, the second symbol associated with a second value;

(e) for each determined second reel outcome that includes the second symbol:

(i) alter the game parameter value based on the second value, said alteration of the game parameter value based on the second value reducing the possible award amount, and (ii) display a representation of the second symbol performing an action on a representation of the game parameter value; and (f) provide a payout amount based on the possible award amount associated with the game parameter value after any alteration to said possible award amount.

18. The method of claim 17, further comprising causing the at least one processor to terminate the game session.

19. The method of claim 17, wherein the game parameter value includes a running count, and wherein the possible award amount is based on the running count.

20. The method of claim 17, wherein the game parameter value includes a running count of first symbols and second symbols.

21. The method of claim 17, wherein the game parameter value includes a running count of game elements.

22. The method of claim 17, wherein the game parameter value includes a running count of symbols.

23. The method of claim 17, which includes, if the determination is that the determined first reel outcome includes the first symbol, causing the at least one processor to display an indication that the possible award amount is a maximum obtainable award amount for the game session.

24. The method of claim 17, wherein the outcome in the secondary game does not include a reel outcome.

25. The method of claim 17, which includes causing the at least one processor to enable play of the basic game concurrently with play of the secondary game.

26. The method of claim 17, wherein at least one outcome of the play of the secondary game further reduces the possible award amount.

27. A method of operating a gaming system, said method comprising, for each play of a game:

causing at least one processor of a gaming device to operate with at least one memory device, at least one display device, and at least one input device to:

determine a current state of the play of the game, wherein:

(a) the game includes at least a first state and a second state, (b) the first state is associated with:

(i) a first non-zero probability of a first game event occurring, and (ii) a maximum possible award, (c) the second state is associated with:

(i) a second non-zero probability of the first game event occurring, (ii) a third non-zero probability of a second game event occurring, an occurrence of the second game event causing a reduction of the maximum possible award associated with the first state to result in an actual award, and (iii) a fourth non-zero probability of the first and second events occurring simultaneously, and (d) the first non-zero probability is different from the second non-zero probability;

determine whether the first game event, the second game event, or both the first game event and the second game event, has occurred based on the determined current state of the play of the game, wherein if the determination is that the second game event has occurred for the play of the game:

(a) display an indication of the reduction of the maximum possible award and (b) determine the resulting actual award; and provide the determined actual award for said play of the game.

28. The method of claim 27, further comprising, for each play of the game, causing the at least one processor to select either the first probability of the first game event occurring or the second probability of the first game event occurring based on the determined state of the game, and causing the at least one processor to determine whether the first game event has occurred based on the selected probability.

29. The method of claim 27, further comprising, for each play of the game, causing the at least one processor to adjust a parameter value associated with the game if the determination is that first game event has occurred.

30. The method of claim 27, further comprising, for each play of the game, causing the at least one processor to determine the award based, at least in part, on whether the determination is that the first game event has occurred.

31. The method of claim 27, wherein the second non-zero probability is greater than the first non-zero probability.

* * * * *

UNITED STATES PATENT AND TRADEMARK OFFICE

CERTIFICATE OF CORRECTION

PATENT NO. : 7,722,456 B2
APPLICATION NO. : 10/794981
DATED : May 25, 2010
INVENTOR(S) : Walker et al.

It is certified that error appears in the above-identified patent and that said Letters Patent is hereby corrected as shown below:

IN THE CLAIMS:

In Claim 27, Column 38, line 28, replace "award and" with --award; and--.

Signed and Sealed this

Seventeenth Day of August, 2010

David J. Kappos

David J. Kappos
*Director of the United States Patent and Trademark Office*